US010468756B2

(12) United States Patent
Han et al.

(10) Patent No.: US 10,468,756 B2
(45) Date of Patent: Nov. 5, 2019

(54) ANTENNAS HAVING SYMMETRICAL SWITCHING ARCHITECTURE

(71) Applicant: Apple Inc., Cupertino, CA (US)

(72) Inventors: Xu Han, San Jose, CA (US); Liang Han, Sunnyvale, CA (US); Matthew A. Mow, Los Altos, CA (US); Ming-Ju Tsai, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 35 days.

(21) Appl. No.: 15/940,772

(22) Filed: Mar. 29, 2018

(65) Prior Publication Data

US 2018/0219276 A1 Aug. 2, 2018

Related U.S. Application Data

(63) Continuation of application No. 15/429,597, filed on Feb. 10, 2017.

(Continued)

(51) Int. Cl.
*H01Q 9/42* (2006.01)
*H01Q 1/24* (2006.01)

(Continued)

(52) U.S. Cl.
CPC ..... *H01Q 1/243* (2013.01); *H01Q 5/328* (2015.01); *H01Q 5/335* (2015.01); *H01Q 9/30* (2013.01);

(Continued)

(58) Field of Classification Search
CPC ..... H01Q 5/329; H01Q 5/328
See application file for complete search history.

(56) References Cited

U.S. PATENT DOCUMENTS 8,890,752 B2 11/2014 Song et al.
9,331,397 B2 5/2016 Jin et al.

(Continued)

FOREIGN PATENT DOCUMENTS

KR 10-2014-0116553 10/2014
KR 10-2015-0110783 10/2015

OTHER PUBLICATIONS

Ding et al., "A novel dual-band printed diversity antenna for mobile terminals", IEEE Transactions on Antennas and Propagation 55.7 (2007): 2088-2096. <http://pure.qub.ac.uk/portal/files/18190630/A_Novel_Dual_band_Printed_Diversity_Antenna_for_Mobile_Terminals.pdf>.

(Continued)

*Primary Examiner* — Graham P Smith
(74) *Attorney, Agent, or Firm* — Treyz Law Group, P.C.; Michael H. Lyons

(57) ABSTRACT

An electronic device may include wireless circuitry with antennas. An antenna resonating element arm for an antenna may be formed from conductive housing structures running along the edges of the device. The antenna may have first and second antenna feeds and multiple adjustable components that bridge a slot between the antenna resonating element and an antenna ground. Control circuitry may control the adjustable components and selectively activate one of the first and second feeds at a given time to place the antenna in first, second, or third operating modes. The control circuitry may determine which operating mode to use based on information indicative of the operating environment of the device. By switching between the operating modes, the control circuitry may shift current hot spots across the length of the resonating element arm to ensure satisfactory performance of the antenna in a variety of operating conditions.

20 Claims, 15 Drawing Sheets

Related U.S. Application Data

(60) Provisional application No. 62/398,375, filed on Sep. 22, 2016.

(51) Int. Cl.

| | |
|---|---|
| ***H01Q 13/10*** | (2006.01) |
| ***H01Q 21/28*** | (2006.01) |
| ***H01Q 5/328*** | (2015.01) |
| ***H01Q 5/335*** | (2015.01) |
| ***H01Q 9/30*** | (2006.01) |
| ***H01Q 19/02*** | (2006.01) |

(52) U.S. Cl.
CPC ..... *H01Q 9/42* (2013.01); *H01Q 13/106* (2013.01); *H01Q 19/021* (2013.01); *H01Q 21/28* (2013.01)

(56) References Cited

U.S. PATENT DOCUMENTS

| | | | |
|---|---|---|---|
| 9,537,223 | B2 | 1/2017 | Hall et al. |
| 9,553,361 | B2 | 1/2017 | Hu et al. |
| 2016/0164168 | A1 | 6/2016 | Choi et al. |
| 2016/0322699 | A1 | 11/2016 | Mow et al. |
| 2017/0033460 | A1 | 2/2017 | Ayala Vazquez et al. |
| 2017/0040668 | A1 | 2/2017 | Ayala Vazquez et al. |

OTHER PUBLICATIONS

Wang et al., "Researches on reconfigurable antenna in CEMLAB at UESTC", Journal of Electronic Science and Technology of China vol. 4 (2006): 226. <http://data.eefocus.com/myspace/0/983/bbs/1176546832/4dafd74a.pdf>.

Han et al., U.S. Appl. No. 15/255,770, filed Sep. 2, 2016.

ANTENNAS HAVING SYMMETRICAL SWITCHING ARCHITECTURE

This application is a continuation of patent application Ser. No. 15/429,597, filed Feb. 10, 2017, which claims the benefit of provisional patent application No. 62/398,375, filed Sep. 22, 2016, which are hereby incorporated by reference herein in their entireties.

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It can be challenging to form electronic device antenna structures with desired attributes. In some wireless devices, antennas are bulky. In other devices, antennas are compact, but are sensitive to the position of the antennas relative to external objects. If care is not taken, antennas may become detuned, may emit wireless signals with a power that is more or less than desired, or may otherwise not perform as expected.

It would therefore be desirable to be able to provide improved wireless circuitry for electronic devices.

SUMMARY

An electronic device may have wireless circuitry with antennas. An antenna may be formed from an antenna resonating element arm and an antenna ground. The antenna resonating element arm and antenna ground may be formed from metal housing structures or other conductive structures that are separated by a slot. The antenna resonating element arm may, for example, be formed from peripheral conductive structures running along the edges of the metal housing structures and an elongated opening in the metal housing structures may separate the antenna resonating element arm from a planar portion of the metal housing structures that serves as the antenna ground.

The antenna may have a first antenna feed having a positive feed terminal coupled to a first location on the resonating element arm and a second antenna feed having a positive feed terminal coupled to a second location on the resonating element arm. The resonating element arm may have opposing first and second ends. The antenna feeds and other components may be coupled between the resonating element arm and the antenna ground symmetrically around the longitudinal axis of the device. For example, the second location may be interposed between the first location and the second end of the resonating element arm. A first adjustable component may be coupled between a third location on the resonating element arm and the antenna ground. The third location may be interposed between the first location and the first end of the resonating element arm. A second adjustable component may be coupled between a fourth location on the resonating element arm and the antenna ground. The fourth location may be interposed between the second location and the second end of the resonating element arm. A third adjustable component may be coupled between a fifth location on the resonating element arm and the antenna ground. The fifth location may be interposed between the fourth location and the second end of the resonating element arm.

The first antenna feed terminal may be coupled to the first location on the resonating element arm by a fourth adjustable component. The fourth adjustable component may include a shunt switch coupled between the first antenna feed terminal and the antenna ground. During operation, loading of the antenna by an external object such as a user's hand can detune the antenna. The loading of the antenna may be dependent on how the user holds the device (e.g., whether the user holds the device with a left or right hand).

The electronic device may include control circuitry that controls the first, second, third, and fourth adjustable components and that selectively activates one of the first and second feeds at a given time to place the antenna in a first, second, or third operating mode (e.g., a free space mode, a left hand head mode, and a right hand head mode). As an example, the control circuitry may close the shunt switch to form a short circuit path between the resonating element arm and the antenna ground when the first antenna feed is inactive (disabled) and may open the shunt switch when the first antenna feed is active (enabled). The control circuitry may enable the first antenna feed and disable the second antenna feed in the free space and left hand head operating modes. The control circuitry may enable the second antenna feed and disable the first antenna feed in the right hand head operating mode. The control circuitry may determine which operating mode to use based on sensor data gathered by sensor circuitry and/or any other desired information about the operating environment of the device. By switching between the operating modes, the control circuitry may shift antenna current hot spots across the length of the resonating element arm to ensure satisfactory performance of the antenna in a variety of operating conditions.

DETAILED DESCRIPTION

Figure 1:
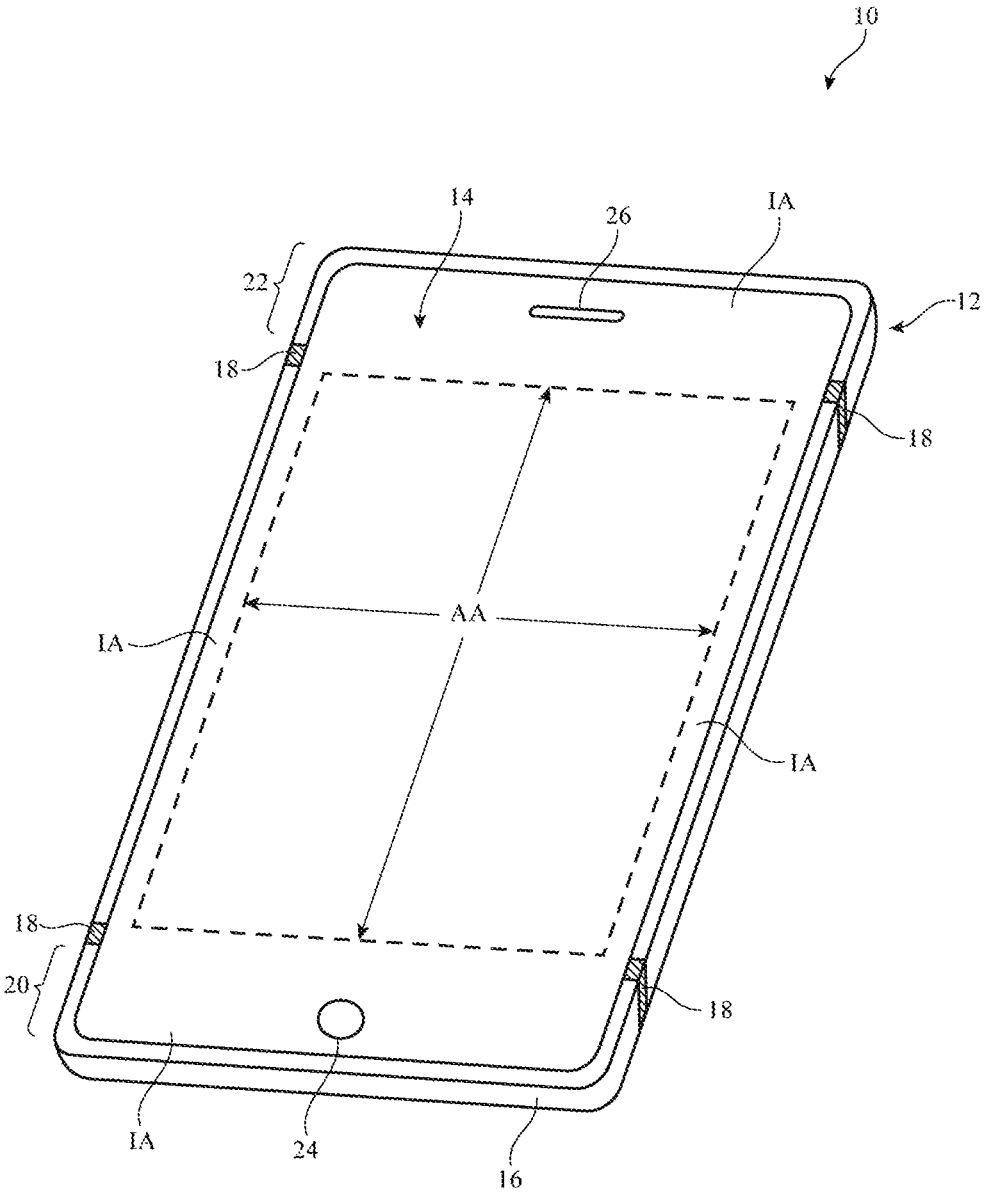
FIG. 1 is a perspective view of an illustrative electronic device in accordance with an embodiment.

Electronic devices such as electronic device 10 of FIG. 1 may be provided with wireless communications circuitry. The wireless communications circuitry may be used to support wireless communications in multiple wireless communications bands.

The wireless communications circuitry may include one more antennas. The antennas of the wireless communications circuitry can include loop antennas, inverted-F antennas, strip antennas, planar inverted-F antennas, monopole antennas, dipole antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane formed from conductive housing structures such as metal housing midplate structures and other internal device structures. Rear housing wall structures may be used in forming antenna structures such as an antenna ground.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a planar housing wall. The rear housing wall may be have slots that pass entirely through the rear housing wall and that therefore separate housing wall portions (and/or sidewall portions) of housing 12 from each other. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalls that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions.

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a midplate) that spans the walls of housing 12 (i.e., a substantially rectangular sheet formed from one or more parts that is welded or otherwise connected between opposing sides of member 16). Device 10 may also include conductive structures such as printed circuit boards, components mounted on printed circuit boards, and other internal conductive structures. These conductive structures, which may be used in forming a ground plane in device 10, may be located in the center of housing 12 and may extend under active area AA of display 14.

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air, plastic, and other dielectrics and may be used in forming slot antenna resonating elements for one or more antennas in device 10.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22. In configurations for device 10 with narrow U-shaped openings or other openings that run along the edges of device 10, the ground plane of device 10 can be enlarged to accommodate additional electrical components (integrated circuits, sensors, etc.).

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with peripheral gap structures. For example, peripheral conductive housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two of gaps 18), three peripheral conductive segments (e.g., in an arrangement with three of gaps 18), four peripheral conductive segments (e.g., in an arrangement with four gaps 18, etc.). The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme, if desired.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
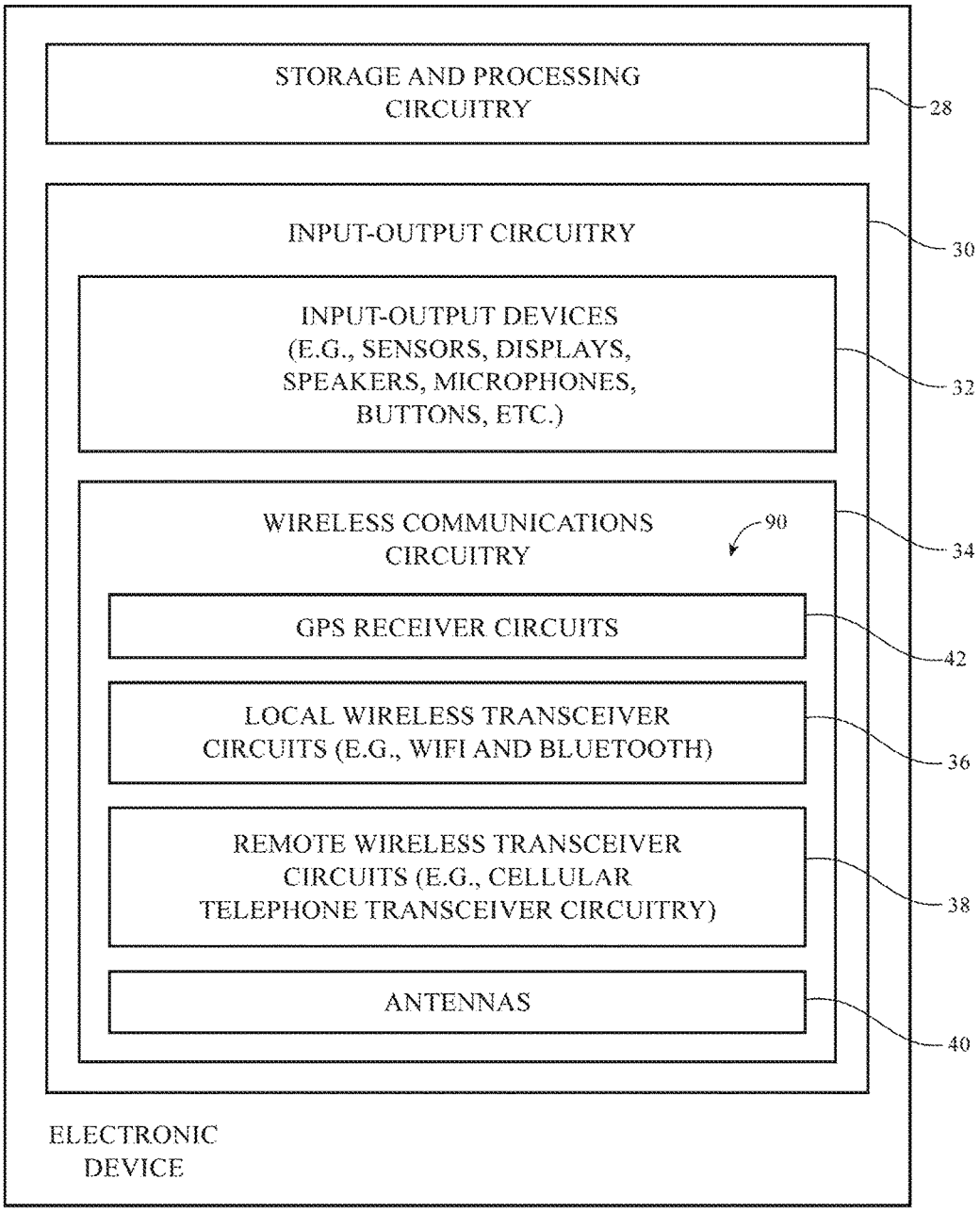
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc. Storage and processing circuitry 28 may sometimes be referred to herein as control circuitry 28.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors (e.g., a fingerprint sensor integrated with a button such as button 24 of FIG. 1 or a fingerprint sensor that takes the place of button 24), etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a low-midband from 960 to 1710 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
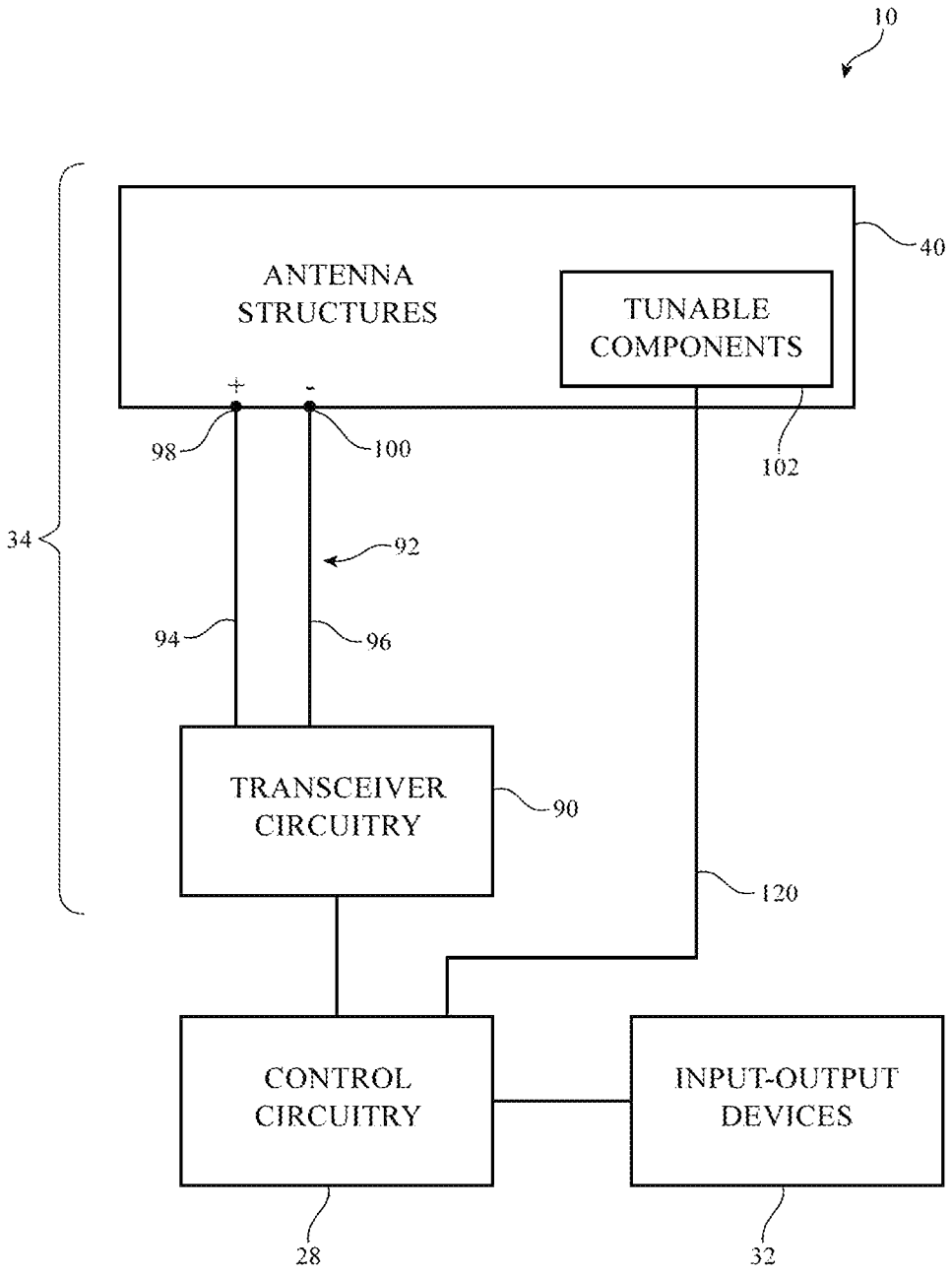
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna(s) 40 may be provided with adjustable circuits such as tunable components 102 to tune antennas over communications bands of interest. Tunable components 102 may be part of a tunable filter or tunable impedance matching network, may be part of an antenna resonating element, may span a gap between an antenna resonating element and antenna ground, etc. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 120 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna(s) 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. For example, antenna structures 40 may be fed using multiple feeds. The illustrative feeding configuration of FIG. 3 is merely illustrative.

Control circuitry 28 may use an impedance measurement circuit to gather antenna impedance information. Control circuitry 28 may use information from a proximity sensor (see, e.g., sensors 32 of FIG. 2), received signal strength information, device orientation information from an orientation sensor, information from a connector sensor that senses the presence of a digital connector adjacent to antenna 40, information identifying whether wired or wireless headphones are being used with device 10, information identifying a type of headphones that are being used with device 10, information from one or more antenna impedance sensors, information on the operating state or usage scenario of device 10, or other information in determining when antenna 40 is being affected by the presence of nearby external objects or is otherwise in need of tuning. In response, control circuitry 28 may adjust an adjustable inductor, adjustable capacitor, switch, or other tunable components 102 to ensure that antenna 40 operates as desired. Adjustments to components 102 may also be made to extend the coverage of antenna 40 (e.g., to cover desired communications bands that extend over a range of frequencies larger than antenna 40 would cover without tuning).

Figure 4:
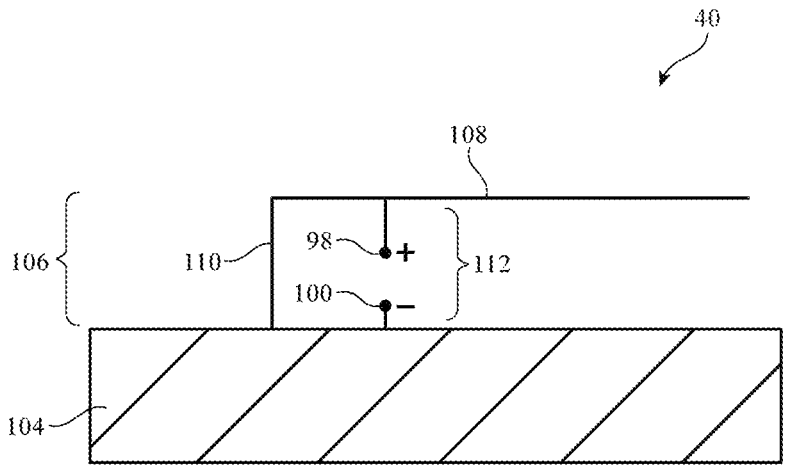
FIG. 4 is a schematic diagram of an illustrative inverted-F antenna in accordance with an embodiment.

FIG. 4 is a diagram of illustrative inverted-F antenna structures that may be used in implementing antenna 40 for device 10. Inverted-F antenna 40 of FIG. 4 has antenna resonating element 106 and antenna ground (ground plane) 104. Antenna resonating element 106 may have a main resonating element arm such as arm 108. The length of arm 108 and/or portions of arm 108 may be selected so that antenna 40 resonates at desired operating frequencies. For example, the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. An inductor or other component may be interposed in path 110 and/or tunable components 102 may be interposed in path 110 and/or coupled in parallel with path 110 between arm 108 and ground 104.

Antenna 40 may be fed using one or more antenna feeds. For example, antenna 40 may be fed using antenna feed 112. Antenna feed 112 may include positive antenna feed terminal 98 and ground antenna feed terminal 100 and may run in parallel to return path 110 between arm 108 and ground 104. If desired, inverted-F antennas such as illustrative antenna 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.). For example, arm 108 may have left and right branches that extend outwardly from feed 112 and return path 110. Multiple feeds may be used to feed antennas such as antenna 40.

Figure 5:
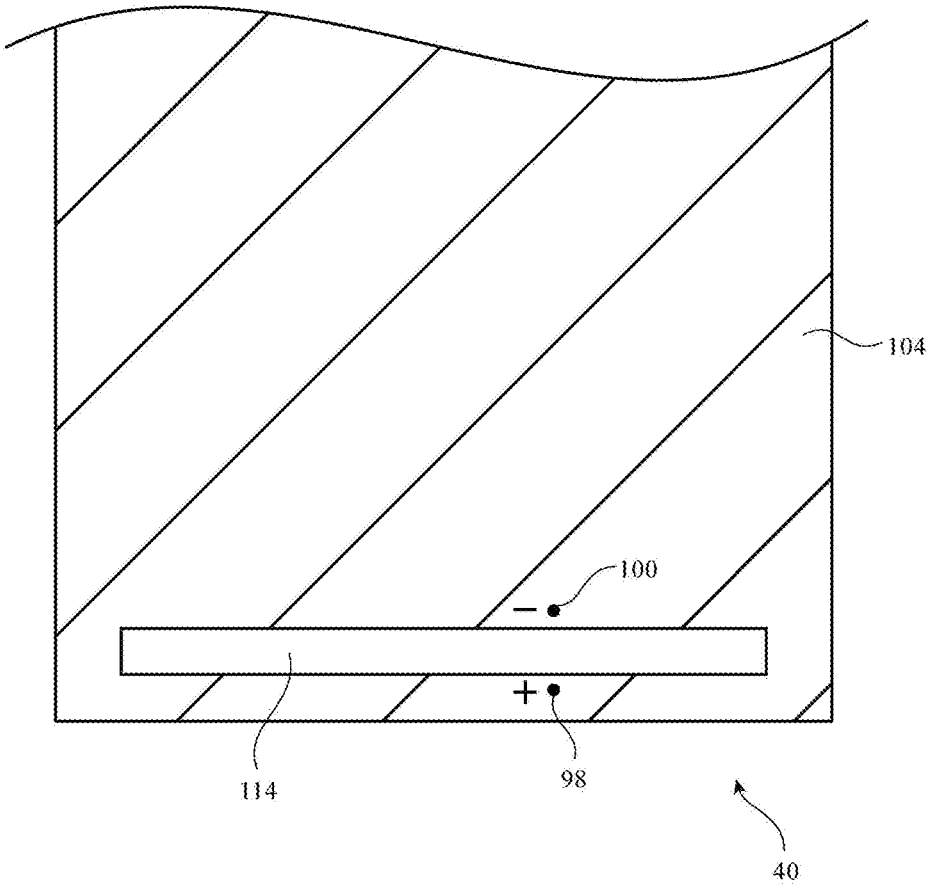
FIG. 5 is a schematic diagram of an illustrative slot antenna in accordance with an embodiment.

Antenna 40 may be a hybrid antenna that includes one or more slot antenna resonating elements. As shown in FIG. 5, for example, antenna 40 may be based on a slot antenna configuration having an opening such as slot 114 that is formed within conductive structures such as antenna ground 104. Slot 114 may be filled with air, plastic, and/or other dielectric. The shape of slot 114 may be straight or may have one or more bends (i.e., slot 114 may have an elongated shape following a meandering path). The antenna feed for antenna 40 may include positive antenna feed terminal 98 and ground antenna feed terminal 100. Feed terminals 98 and 100 may, for example, be located on opposing sides of slot 114 (e.g., on opposing long sides). Slot-based antenna resonating elements such as slot antenna resonating element 114 of FIG. 5 may give rise to an antenna resonance at frequencies in which the wavelength of the antenna signals is equal to the perimeter of the slot. In narrow slots, the resonant frequency of a slot antenna resonating element is associated with signal frequencies at which the slot length is equal to a half of a wavelength. Slot antenna frequency response can be tuned using one or more tunable components such as tunable inductors or tunable capacitors. These components may have terminals that are coupled to opposing sides of the slot (i.e., the tunable components may bridge the slot). If desired, tunable components may have terminals that are coupled to respective locations along the length of one of the sides of slot 114. Combinations of these arrangements may also be used.

Antenna 40 may be a hybrid slot-inverted-F antenna that includes resonating elements of the type shown in both FIG. 4 and FIG. 5. An illustrative configuration for an antenna with slot and inverted-F antenna structures is shown in FIG. 6.

The presence or absence of external objects such as a user's hand or other body part in the vicinity of antenna 40 may affect antenna loading and therefore antenna performance. Antenna loading may differ depending on the way in which device 10 is being held. For example, antenna loading and therefore antenna performance may be affected in one way when a user is holding device 10 in the user's right hand and may be affected in another way when a user is holding device 10 in the user's left hand. In addition, antenna loading and performance may be affected in one way when a user is holding device 10 to the user's head and in another way when the user is holding device 10 away from the user's head. To accommodate various loading scenarios, device 10 may use sensor data, antenna measurements, information about the usage scenario or operating state of device 10, and/or other data from input-output circuitry 30 to monitor for the presence of antenna loading (e.g., the presence of a user's hand, the user's head, or another external object). Device 10 (e.g., control circuitry 28) may then adjust adjustable components 102 in antenna 40 to compensate for the loading.

In order to help compensate for antenna loading due to the presence of external objects such as the user's hand at different locations relative to device 10, antenna 40 may include multiple antenna feeds (e.g., antenna feeds such as antenna feed 112 of FIG. 4). Control circuitry 28 may selectively activate one of the multiple antenna feeds at a given time. For example, control circuitry 28 may selectively activate the antenna feed that is located farthest away from an external object that is loading the antenna to help minimize the impact of the presence of the external object on the performance of antenna 40.

Figure 6:
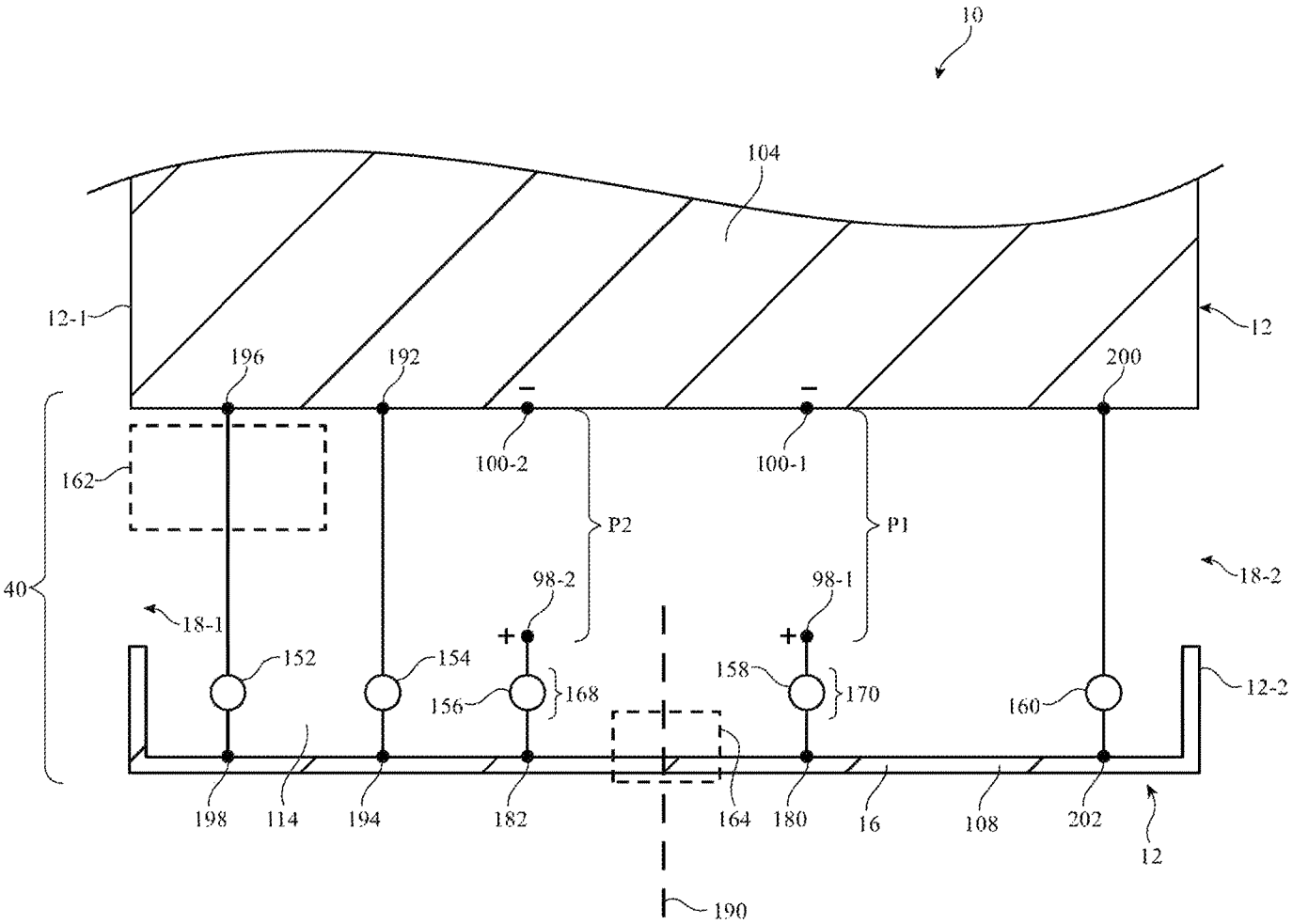
FIG. 6 is a diagram of illustrative antenna structures having a symmetric switching architecture in accordance with an embodiment.

As shown in FIG. 6, antenna 40 (e.g., a hybrid slot-inverted-F antenna) may include a first antenna feed P1 and a second antenna feed P2 (sometimes referred to herein as first antenna port P1 and second antenna port P2). Antenna 40 of FIG. 6 may be, for example, a lower antenna formed within region 20 of device 10 (FIG. 1). Feeds P1 and P2 may be fed by transceiver circuitry that is coupled to feeds P1 and P2 over one or more corresponding transmission lines 92. Antenna 40 may include a slot such as slot 114 that is formed from an elongated gap between peripheral conductive structures 16 and ground 104 (e.g., a slot formed in housing 12 using machining tools or other equipment). The slot may be filled with dielectrics such as air and/or plastic. For example, plastic may be inserted into portions of slot 114 and this plastic may be flush with the outside of housing 12. If desired, a connector port such as connector port 164 may be formed in peripheral structures 16. Connector port 164 may receive a mating digital connector or other connector structure. Connector port 164 may receive data signals and/or power from the connector structure and/or may provide data signals to the connector structure when inserted in port 164.

Portions of slot 114 may contribute slot antenna resonances to antenna 40. Peripheral conductive structures 16 may form an antenna resonating element arm such as arm 108 of FIG. 4 that extends between gaps 18-1 and 18-2 (e.g., gaps 18 in peripheral conductive structures 16). For example, a first end of the segment of peripheral structures 16 that forms resonating element arm 108 may define an edge of gap 18-1 whereas an opposing second end of the segment of peripheral structures 16 defines an edge of gap 18-2. First and second antenna feeds P1 and P2 may include respective positive antenna feed terminals 98 and ground antenna feed terminals 100 (FIG. 3). For example, first antenna feed P1 may include a positive antenna feed terminal 98-1 and a corresponding ground antenna feed terminal 100-1 that are coupled to opposing sides of slot 114. Positive antenna feed terminal 98-1 may be coupled to peripheral conductive structures 16 via feed leg 170 whereas ground antenna feed terminal 100-1 is coupled to a first location along ground plane 104. Second antenna feed P2 may include a positive antenna feed terminal 98-2 and a corresponding ground antenna feed terminal 100-2. Positive antenna feed terminal 98-2 may be coupled to peripheral conductive structures 16 via feed leg 168 whereas ground antenna feed terminal 100-2 is coupled to a second location along ground plane 104. Feed legs 168 and 170 may sometimes be referred to herein as feed arms, feed paths, feed conductors, or feed elements. Feed legs 168 and 170 may include any desired conductive structures such as conductive wire, metal traces on a rigid or flexible printed circuit board, sheet metal, metal portions of electronic device components, conductive radio-frequency connectors, conductive spring structures, metal screws or other fasteners, weld structures, solder structures, conductive adhesive structures, combinations of these structures, etc.

Feed leg 170 may be coupled to peripheral conductive structures 16 at point 180 whereas feed leg 168 is coupled to peripheral conductive structures 16 at point 182. Point 182 may, for example, be located at a given distance from gap 18-1 (e.g., along the width of device 10). If desired, point 180 may also be coupled to peripheral structures 16 at the same given distance from gap 18-2. Similarly, ground feed terminal 100-2 may be coupled to ground plane 104 at the same distance with respect to gap 18-1 as ground terminal 100-1 is with respect to gap 18-2. In other words, antenna feeds P1 and P2 may be symmetrically distributed across the width of device 10 (e.g., about the longitudinal axis 190 of device 10 running down the center and along the longest dimension of the device). This example is merely illustrative. In general, antenna feed P2 may be coupled between ground 104 and peripheral structures 16 at any desired location that is interposed between antenna feed P1 and gap 18-1. Antenna feed P1 may be coupled between ground 104 and peripheral structures 16 at any desired location that is interposed between antenna feed P2 and gap 18-2. Ground antenna feed terminals 100-2 and 100-1 may be coupled to antenna ground 104 at any desired locations (e.g., either symmetrically or asymmetrically distributed about longitudinal axis 190) and/or feed legs 168 and 170 may be coupled to conductive structures 16 at any desired locations (e.g., either symmetrically or asymmetrically distributed about the longitudinal axis 190).

Adjustable tuning components 102 of FIG. 3 may include adjustable (tunable) components such as components 152, 154, 156, 158, and 160 of FIG. 6. Adjustable component 156 may be interposed on feed leg 168 between positive feed terminal 98-2 and peripheral structures 16. Adjustable component 158 may be interposed on feed leg 170 between positive feed terminal 98-1 and peripheral structures 16. Control circuitry 28 may adjust components 156 and 158 to adjust the performance of antenna 40. For example, control circuitry 28 may adjust components 156 and 158 to selectively activate one of antenna feeds P1 and P2 at a given time.

In one suitable arrangement, adjustable component 158 may include switching circuitry such as a shunt single-pole double-throw (SP2T) switch or any other desired switching circuitry. When antenna feed P1 is to be activated (enabled), control circuitry 28 may adjust the switching circuitry in adjustable component 158 to route radio-frequency antenna signals between antenna feed terminal 98-1 and peripheral structures 16. When antenna feed P1 is to be deactivated (disabled), control circuitry 28 may adjust the switching circuitry in adjustable component 158 to short radio-frequency antenna signals conveyed over path 170 to ground.

If desired, adjustable component 156 may include switching circuitry such as a single-pole single-throw (SPST) switch or any other desired switching circuitry. The SPST switch may, for example, be coupled in series between feed terminal 98-2 and point 182 on peripheral structures 16. When antenna feed P2 is to be activated, control circuitry 28 may close the switch in adjustable component 156 to route signals between feed terminal 98-2 and peripheral structures 16. When antenna feed P2 is to be deactivated, control circuitry 28 may open the switch in adjustable component 156 to form an open circuit between antenna feed terminal 98-2 and peripheral structures 16 (e.g., so that signals are not conveyed between feed terminal 98-2 and peripheral structures 16).

Adjustable component 154 may be coupled between ground 104 and peripheral structures 16 (e.g., a first terminal 192 of adjustable component 154 may be coupled to ground 104 whereas a second terminal 194 of adjustable component 154 is coupled to peripheral structures 16). Terminal 194 of adjustable component 154 may be interposed between point 182 and gap 18-1. Terminal 192 of adjustable component 154 may be interposed between ground antenna feed terminal 100-2 and gap 18-1. Adjustable component 154 may include switchable inductors and resistors coupled in parallel between ground 104 and peripheral structures 16, for example. Control circuitry 28 may adjust component 154 to tune the resonant frequency of antenna 40 and/or to adjust the antenna efficiency of antenna 40. Component 154 may sometimes be referred to herein as aperture tuning circuitry 154 or aperture tuner 154 (e.g., because adjusting component 154 may effectively tune or adjust the aperture or perimeter of slot 114).

Adjustable component 152 may be coupled between ground 104 and peripheral structures 16 (e.g., a first terminal 196 of adjustable component 152 may be coupled to ground 104 whereas a second terminal 198 of adjustable component 152 is coupled to peripheral structures 16). Terminal 198 of adjustable component 152 may be interposed between terminal 194 of adjustable component 154 and gap 18-1. Terminal 196 of adjustable component 152 may be interposed between terminal 192 of adjustable component 154 and gap 18-1. Adjustable component 152 may include switching circuitry such as a single-pole double-throw (SP2T) switch or any other desired switching circuitry. Control circuitry 28 may adjust the switching circuitry in component 152 to tune the resonant frequency of antenna 40, for example.

Adjustable component 160 may be coupled between ground 104 and peripheral structures 16 (e.g., a first terminal 200 of adjustable component 160 may be coupled to ground 104 whereas a second terminal 202 of adjustable component 160 is coupled to peripheral structures 16). Terminal 202 may be interposed between point 180 of feed leg 170 and gap 18-2. Terminal 200 may be interposed between ground antenna feed terminal 100-1 and gap 18-2. Adjustable component 160 may include switching circuitry such as a single-pole double-throw (SP2T) switch or any other desired switching circuitry. Control circuitry 28 may adjust the switching circuitry in component 160 to tune the resonant frequency of antenna 40, for example.

In one suitable arrangement, adjustable component 152 may be identical to adjustable component 160. Control circuitry 28 may control adjustable components 152 and 160 to both be in the same state at any given time, for example. Terminal 198 and 196 may, if desired, be located at the same distance with respect to gap 18-1 as terminals 200 and 202 are located with respect to gap 18-2 (e.g., components 152 and 160 may be symmetrically distributed about longitudinal axis 190). This example is merely illustrative. In general, adjustable component 152 may be coupled between ground 104 and peripheral structures 16 at any desired location between adjustable component 154 and gap 18-1 and adjustable component 160 may be coupled between ground 104 and peripheral structures 16 at any desired location between antenna feed P1 and gap 18-2.

During operation, components 152, 154, 158, and 160 may form return paths for antenna 40 such as path 110 of FIG. 4. For example, return paths may be formed by components 152, 154, 158, and/or 160 when switches in the adjustable components are closed to form a short circuit across slot 114. Using switchable return paths and multiple selectively-activated antenna feeds may provide antenna 40 with flexibility to accommodate different loading conditions (e.g., different loading conditions that may arise due to the presence of a user's hand or other external object on various different portions of device 10 adjacent to various different corresponding portions of antenna 40).

Adjustable components such as components 152, 154, 156, 158, and 160 (see, e.g., components 102 of FIG. 3) may be used in adjusting the operation of antenna 40. Components 152, 154, 156, 158, and 160 may include switches such as adjustable return path switches, switches coupled to fixed components such as inductors and capacitors and other circuitry for providing adjustable amounts of capacitance, adjustable amounts of inductance, open and closed circuits, etc. Adjustable components in antenna 40 may be used to tune antenna coverage, may be used to restore antenna performance that has been degraded due to the presence of an external object such as a hand or other body part of a user, and/or may be used to adjust for other operating conditions and to ensure satisfactory operation at desired frequencies.

To enhance frequency coverage for antenna 40, antenna 40 may be provided with a parasitic antenna resonating element such as parasitic antenna resonating element 162. Element 162 may be formed from conductive structures such as conductive housing structures (e.g., an integral portion of housing such as a portion of housing 12 forming ground 104), from parts of conductive housing structures, from parts of electrical device components, from printed circuit board traces, from strips of conductor (e.g., strips of conductor or elongated portions of ground 104 that are embedded or molded into slot 114), or other conductive materials. In one suitable arrangement, parasitic antenna resonating element 162 is coupled to antenna resonating element 108 (e.g., peripheral structures 16) by near-field electromagnetic coupling and is used to modify the frequency response of antenna 40 so that antenna 40 operates at desired frequencies (e.g., parasitic element 162 may be indirectly fed via near-field coupling whereas peripheral structures 60 are directly fed using antenna feeds P1 and P2). As an example, parasitic antenna resonating element 162 may be based on a slot antenna resonating element structure (e.g., an open slot structure such as a slot with one open end and one closed end or a closed slot structure such as a slot that is completely surrounded by metal). If desired, slots for a slot-based parasitic antenna resonating element may be formed between opposing metal structures in peripheral structures 16 and/or antenna ground 104.

Figure 7:
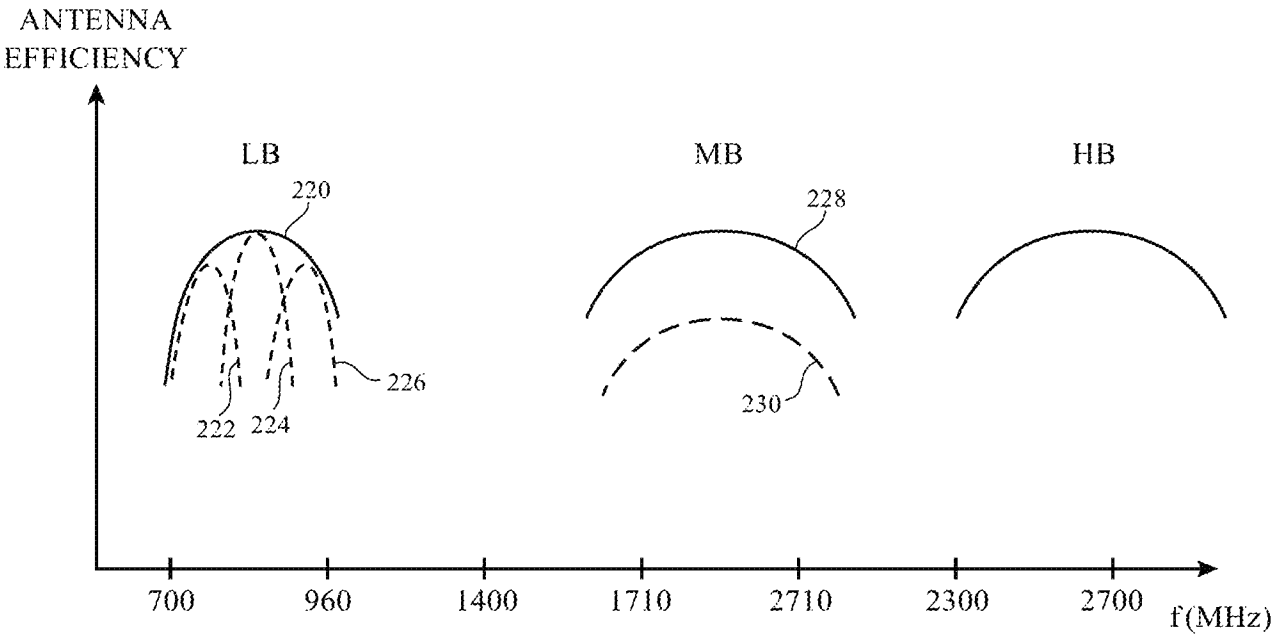
FIG. 7 is a graph in which antenna efficiency has been plotted as a function of operating frequency in accordance with an embodiment.

Antenna 40 of FIG. 6 may be used to cover radio-frequency communications in any desired communications bands. FIG. 7 is a graph in which antenna efficiency has been plotted as a function of operating frequency f for an illustrative antenna such as antenna 40 of FIG. 6 (e.g., including parasitic element 162). As shown in FIG. 7, antenna 40 may exhibit resonances in a low band LB, a midband MB, and a high band HB.

Low band LB may extend from 700 MHz to 960 MHz or may include any other suitable frequency range. Peripheral conductive structures 16 may serve as an inverted-F antenna resonating element arm such as arm 108 of FIG. 4. The resonance of antenna 40 at low band LB may be associated with the distance along peripheral conductive structures 16 between the active one of antenna feeds P1 and P2 and the farther of gaps 18-1 and 18-2 from the active antenna feed, for example. Aperture tuning circuitry 154 may be used to tune the response of antenna 40 in low band LB. As shown in FIG. 7, antenna 40 may have an antenna efficiency characterized by curve 220 in low band LB. The antenna efficiency of curve 220 may be achieved by adjusting aperture tuning circuitry 154 to place antenna 40 in one of three tuning states (e.g., a first state characterized by curve 222, a second state characterized by curve 224, and a third state characterized by curve 226).

High band HB may extend from 2300 MHz to 2700 MHz or within any other suitable frequency range. Antenna performance in high band HB may be supported by the resonance of parasitic antenna resonating element 162 (e.g., the length of element 162 may exhibit a quarter wavelength resonance at operating frequencies in band HB, etc.).

Midband MB may extend from 1710 MHz to 2170 MHz or within any other suitable frequency range. The resonance of antenna 40 at midband MB may be associated with the distance between the active one of antenna feeds P1 and P2 and a return path between peripheral structures 16 and ground 104 formed by one or more components 152, 154, 156, 158 and 160 of FIG. 6, for example. Control circuitry 28 may tune the resonance of antenna 40 within midband MB by adjusting components 152 and/or 160, for example.

The presence or absence of external objects such as a user's hand or other body part in the vicinity of antenna 40 may affect antenna loading and therefore antenna performance. For example, in free space, the performance of antenna 40 in midband MB may be characterized by curve 228 of FIG. 7. In the presence of external loading, however, efficiency may be degraded (see, e.g., degraded efficiency curve 230). In the example of FIG. 7, efficiency in midband MB is degraded. However, in general, efficiency in any frequency bands covered by antenna 40 may be degraded due to the presence of external loading.

Antenna loading may differ depending on the way in which device 10 is being held and depending on which antenna feed is active. In the example of FIG. 6, antenna 40 is shown from the front of device 10 (e.g., through display 14). Edge 12-2 is associated with the right edge of housing 12 when device 10 is viewed from the front and edge 12-1 is associated with the left edge of housing 12 when device 10 is viewed from the front. In this example, when a user is holding device 10 in the user's right hand, the palm of the user's right hand will rest along edge 12-2 of housing 12 and the fingers of the user's right hand (which do not load antenna 40 as much as the user's palm) will rest along edge 12-1 of housing 12. In this situation, if antenna feed P1 is active, loading from the user's right hand may degrade the midband resonance of antenna 40 as shown by curve 230 of FIG. 7. Control circuitry 28 may detect the presence of the user's right hand in this scenario and, in response to such a detection, may deactivate antenna feed P1 and activate antenna feed P2. Activating antenna feed P2 may shift antenna current hotspots on peripheral structures 16 away from the right side (e.g., side 12-2) and towards the left side (e.g., side 12-1) of device 10. This shift of current hotspots may reduce the loading and corresponding detuning of antenna 40 by the user's right hand.

When a user is holding device 10 in the user's left hand, the palm of the user's left hand will rest along the left edge of device 10 (e.g., housing edge 12-1 of FIG. 6) and the fingers of the user's left hand will rest along edge 12-2 of device 10. In this scenario, the palm of the user's hand may load the portion of antenna 40 near to edge 12-1. If antenna feed P2 is active, loading from the user's left hand may degrade the midband resonance of antenna 40 as shown by curve 230 of FIG. 7. Control circuitry 28 may detect the presence of the user's left hand in this scenario and, in response to such a detection, may deactivate antenna feed P2 and activate antenna feed P1. Activating antenna feed P1 may shift antenna current hotspots on peripheral structures 16 away from the left side 12-1 and towards right side 12-2 of device 10. This shift of current hotspots may reduce the loading and corresponding detuning of antenna 40 by the user's left hand.

Control circuitry 28 may also adjust components 152, 154, 156, 158, and 160 to ensure that antenna 40 remains properly tuned regardless of which antenna feed is active and regardless of which of the user's hand is being used to hold the device. For example, control circuitry 28 may place components 152, 154, 156, 158, and 160 in a first tuning state (first tuning setting) when antenna 40 is being held by the user's right hand. Control circuitry 28 may place components 152, 154, 156, 158, and 160 in a second tuning state (second tuning setting) when antenna 40 is being held by the user's left hand. Placing the adjustable components of antenna 40 in the first or second tuning states may undesirably detune the antenna in a free space scenario in which neither hand is loading the antenna. If desired, control circuitry 28 may place adjustable components 152, 154, 156, 158, and 160 in a third tuning state (third tuning setting) when device 10 is operated in the free space scenario. Control circuitry 28 may activate antenna feed P1 and deactivate antenna feed P2 in the third tuning state, for example.

In one suitable arrangement, control circuitry 28 may place the adjustable components of antenna 40 in the first or second tuning states only when device 10 is being held adjacent to the head of the user (e.g., using the right or left hands respectively). The first tuning state may therefore sometimes be referred to herein as the right hand head mode of antenna 40 whereas the second tuning state is sometimes referred to herein as the left hand head mode of antenna 40. Control circuitry 28 may place the adjustable components of antenna 40 in the third tuning state when device 10 is not being held adjacent to the head of a user or when neither of the user's hands is loading antenna 40. The third tuning state may therefore sometimes be referred to herein as the free space mode of antenna 40. By suitably controlling adjustable components 152, 154, 156, 158, and 160 and selectively activating only one of antenna feeds P1 and P2 at a given time, control circuitry 28 may control antenna 40 to ensure that antenna 40 exhibits satisfactory midband antenna efficiency (e.g., as shown by curve 228 of FIG. 7) regardless of whether device 10 is being held by the user's right or left hand or whether device 10 is operating in a free space environment.

The example of FIGS. 6 and 7 is merely illustrative. If desired, the diagram of FIG. 6 may illustrate device antenna 40 from the rear of device 10. In this scenario, edge 12-2 is associated with the left edge of housing 12, edge 12-1 is associated with the right edge of housing 12, antenna feed P1 may be activated when device 10 is held by the user's right hand, and antenna feed P2 may be activated when device 10 is held by the user's left hand. Antenna ground plane 104 and slot 114 may have any desired shape. For example, ground plane 104 may have an extended portion that is closer to peripheral structures 16 than other portions of ground plane 104. Slot 114 may, for example, have a U-shape or other meandering shape that runs around the extended portion of ground plane 104 between ground plane 104 and peripheral structures 16. Antenna 40 may have any desired number of resonances in any desired frequency bands. In the example of FIG. 6, antenna 40 is formed as the lower antenna in region 20 of device 10 (FIG. 1). If desired, the structures of FIG. 6 may be used to form an upper antenna in region 22 for device 10 or an antenna at any other desired location within device 10.

Figure 8:
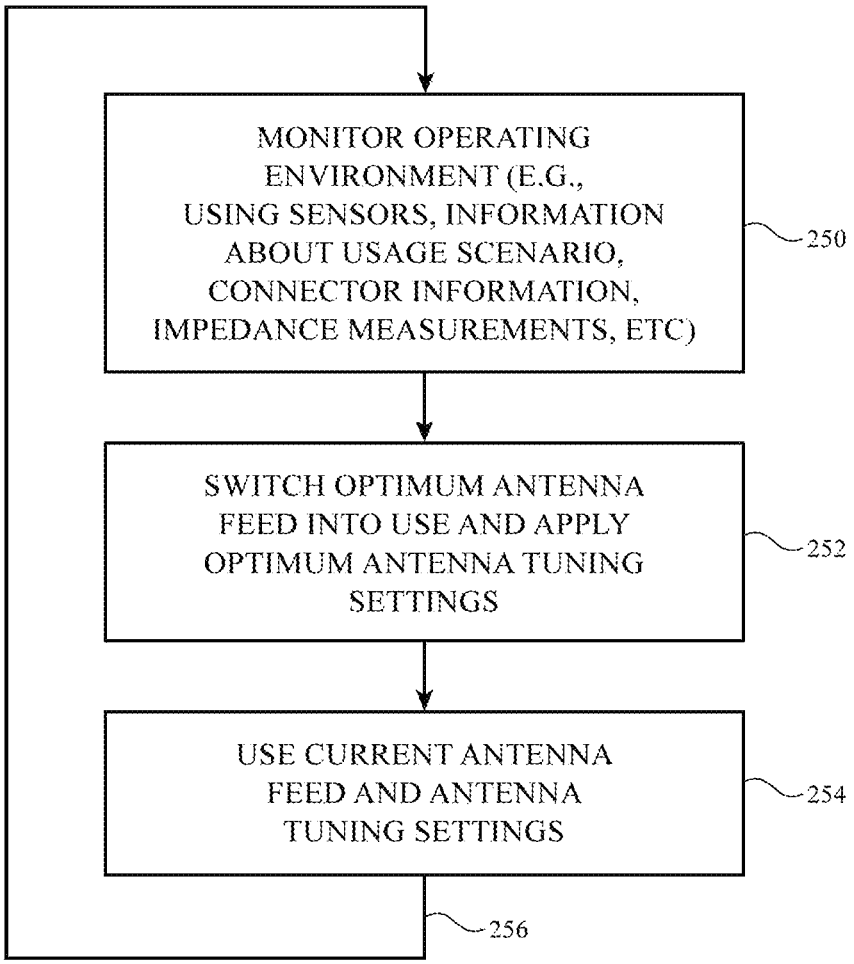
FIG. 8 is a flow chart of illustrative steps that may be involved in operating an electronic device having an antenna of the type shown in FIG. 6 in accordance with an embodiment.

To ensure that antenna 40 operates satisfactorily when the user's right hand is being used to grip device 10 and when the user's left hand is being used to grip device 10 as well as during free space conditions, control circuitry 28 may determine which type of device operating environment is present and may adjust the adjustable circuitry of antenna 40 accordingly to compensate. FIG. 8 is a flow chart of illustrative involved in operating device 10 to ensure satisfactory performance for antenna 40 in all desired frequency bands of interest.

At step 250 of FIG. 8, control circuitry 28 may monitor the operating environment of device 10. Control circuitry 28 may, in general, use any suitable type of sensor measurements, wireless signal measurements, operation information, or antenna measurements to determine how device 10 is being used (e.g., to determine the operating environment of device 10). For example, control circuitry 28 may use sensors such as temperature sensors, capacitive proximity sensors, light-based proximity sensors, resistance sensors, force sensors, touch sensors, connector sensors that sense the presence of a connector in connector port 164 or that detect the presence or absence of data transmission through connector port 164, sensors that detect whether wired or wireless headphones are being used with device 10, sensors that identify a type of headphone or accessory device that is being used with device 10 (e.g., sensors that identify an accessory identifier identifying an accessory that is being used with device 10), or other sensors to determine how device 10 is being used. Control circuitry 28 may also use information from an orientation sensor such as an accelerometer in device 10 to help determine whether device 10 is being held in a position characteristic of right hand use or left hand use (or is being operated in free space). Control circuitry may also use information about a usage scenario of device 10 in determining how device 10 is being used (e.g., information identifying whether audio data is being transmitted through ear speaker 26 of FIG. 1, information identifying whether a telephone call is being conducted, information identifying whether a microphone on device 10 is receiving voice signals, etc.). If desired, an impedance sensor or other sensor may be used in monitoring the impedance of antenna 40 or part of antenna 40. Different antenna loading scenarios may load antenna 40 differently, so impedance measurements may help determine whether device 10 is being gripped by a user's left or right hand or is being operated in free space. Another way in which control circuitry 28 may monitor antenna loading conditions involves making received signal strength measurements on radio-frequency signals being received with antenna 40. In this example, the adjustable circuitry of antenna 40 can be toggled between different settings and an optimum setting for antenna 40 can be identified by choosing a setting that maximizes received signal strength. In general, any desired combinations of one or more of these measurements or other measurements may be processed by control circuitry 28 to identify how device 10 is being used (i.e., to identify the operating environment of device 10).

In a scenario where control circuitry 28 processes orientation information for determining the operating environment of device 10, the orientation information may be gathered using an accelerometer from input-output devices 32 (FIG. 2), for example. The accelerometer may measure a gravity vector having a direction that points towards the earth. Control circuitry 28 may identify the direction of the gravity vector to determine whether device 10 is being held by the user's left or right hand. For example, the gravity vector may have a first component that generally has a positive value when device 10 is being held by the user's left hand and a negative value when device 10 is being held by the user's right hand. Control circuitry 28 may identify the sign of this component of the gravity vector to determine whether device 10 is being held by the user's left or right hand. This is merely illustrative and, in general, any desired sensor data may be used.

At step 252, control circuitry 28 may adjust the configuration of antenna 10 based on the current operating environment of device 10 (e.g., based on data or information gathered while processing step 250). For example, control circuitry 28 may process the data gathered while processing step 250 to determine whether device 10 is being held to the user's head by the user's right hand, whether device 10 is being held to the user's head by the user's left hand, or whether device 10 is in some other operating environment (e.g., a free space environment). If control circuitry 28 determines that device 10 is being held to the user's head by the user's right hand, control circuitry 28 may place antenna 40 in the right hand head mode (e.g., by placing tuning components 152, 154, 156, 158, and 160 in the first tuning state, activating feed P2, and deactivating feed P1). If control circuitry 28 determines that device 10 is being held to the user's head by the user's left hand, control circuitry 28 may place antenna 40 in the left hand head mode (e.g., by placing tuning components 152, 154, 156, 158, and 160 in the second tuning state, activating feed P1, and deactivating feed P2). If control circuitry 28 determines that device 10 is in any other operating environment, control circuitry 28 may place antenna 40 in the free space mode (e.g., by placing tuning components 152, 154, 156, 158, and 160 in the tuning third state, activating feed P1, and deactivating feed P2). By placing antenna 40 in one of these modes, control circuitry 28 may ensure that antenna 40 operates satisfactorily in all frequency bands of interest regardless of how the user is holding device 10.

At step 254, antenna 40 may be used to transmit and receive wireless data in using the currently activated antenna feed and setting for components 152, 154, 156, 158, and 160. This process may be performed continuously, as indicated by line 256.

FIGS. 9-12 show illustrative examples of the electrical components that may be used in forming adjustable components 152, 154, 156, 158, and 160 of FIG. 6 and that may be adjusted to place antenna 40 into the right hand head mode, left hand head mode, or free space mode (e.g., while processing step 252 of FIG. 8).

Figure 9:
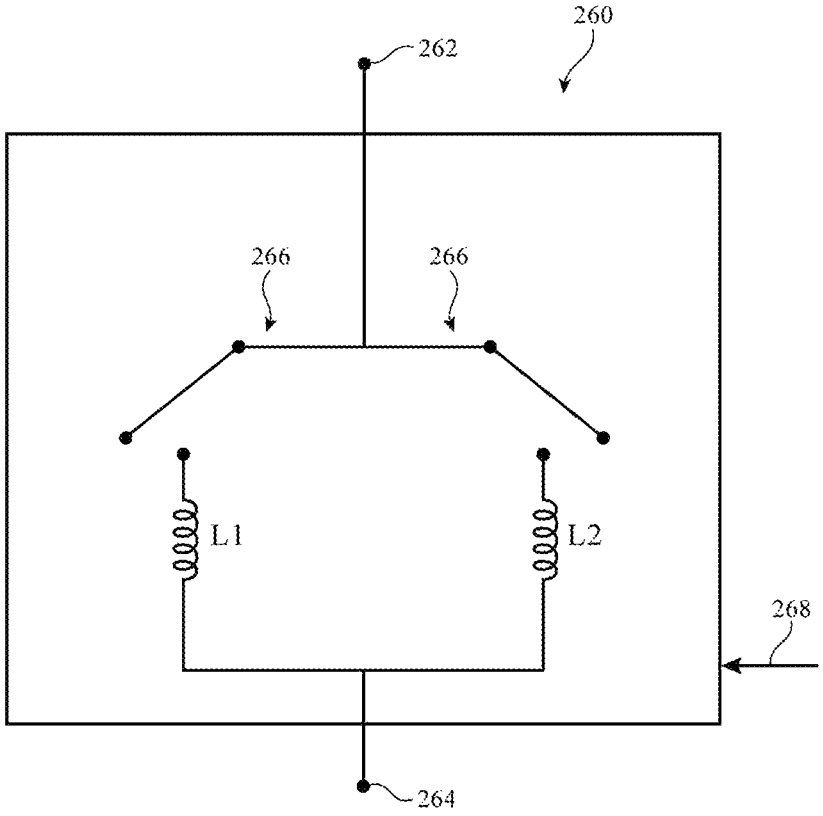
FIG. 9 is a diagram of an illustrative adjustable multi-element inductor that may be used in an antenna in accordance with an embodiment.

FIG. 9 is a circuit diagram showing circuit elements that may be used in forming adjustable components 152 and 160 of FIG. 6. As shown in FIG. 9, adjustable component 260 (e.g., an adjustable component such as component 152 or 156 of FIG. 6) may include multiple inductors that are used in providing antenna 40 with an adjustable amount of inductance (e.g., component 260 may sometimes be referred to as an adjustable inductor or adjustable inductor circuitry). Control circuitry 28 may adjust adjustable inductor circuitry 260 of FIG. 9 to produce different amounts of inductance between terminal 262 (e.g., terminal 196 when implementing adjustable component 152 of FIG. 6 or terminal 200 when implementing adjustable component 160 of FIG. 6) and terminal 264 (e.g., terminal 198 when implementing adjustable component 152 or terminal 202 when implementing adjustable component 160) by controlling the state of switching circuitry such as switch 266 using control signals on control input 268. Switch 266 may be, for example, a single-pole double-throw (SP2T) switch.

Control signals on path 268 may be used to switch inductor L1 into use between terminals 262 and 264 while switching inductor L2 out of use, may be used to switch inductor L2 into use between terminals 262 and 264 while switching inductor L1 out of use, may be used to switch both inductors L1 and L2 into use in parallel between terminals 262 and 264, or may be used to switch both inductors L1 and L2 out of use. The switching circuitry arrangement of adjustable inductor 260 of FIG. 9 is therefore able to produce one or more different inductance values, two or more different inductance values, three or more different inductance values, or, if desired, four different inductance values (e.g., L1, L2, L1 and L2 in parallel, or infinite inductance when L1 and L2 are switched out of use simultaneously). When at least one of inductors L1 and L2 is switched into use, a return path is formed between antenna ground 104 and peripheral structures 16. Control circuitry 28 may adjust the inductance provided by adjustable inductor circuitry 260 to tune the resonant frequency of antenna 40 within midband MB, for example. If desired, the same control signal may be provided to adjustable inductor circuitry 260 in both adjustable components 152 and 160 (FIG. 6) so that both components exhibit the same inductance at a given time. This may allow tuning in midband MB regardless of which of antenna ports P1 and P2 is active.

Figure 10:
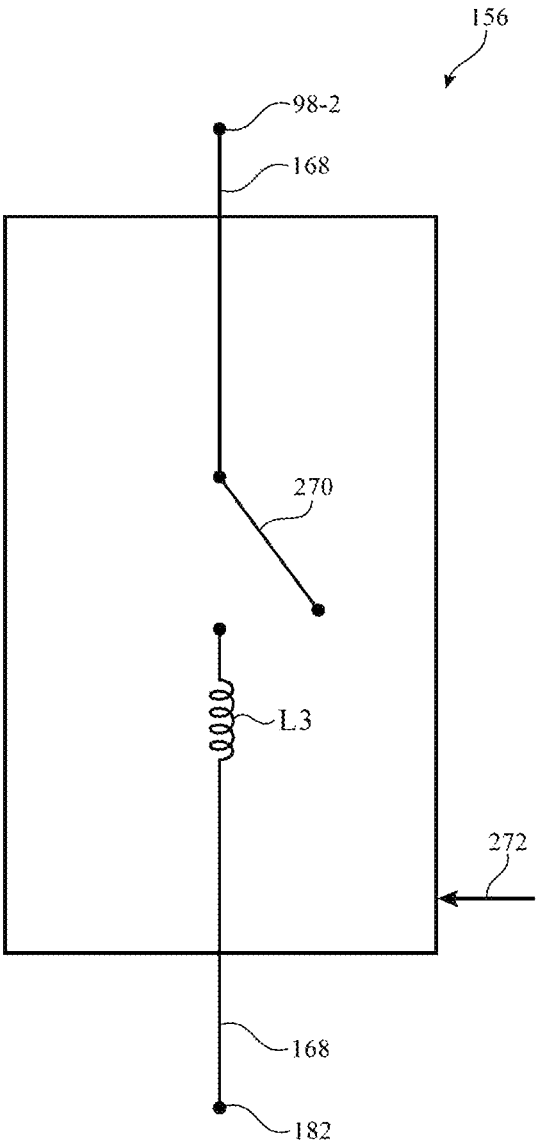
FIG. 10 is a diagram of an illustrative adjustable single-element inductor that may be used in an antenna in accordance with an embodiment.

FIG. 10 is a circuit diagram showing circuit elements that may be used in forming adjustable component 156 of FIG. 6. As shown in FIG. 10, adjustable component 156 may include inductor L2 coupled in series with switch 270 between positive antenna feed terminal 98-2 of antenna feed P2 and terminal 182 (e.g., adjustable component 156 may be interposed on antenna feed path 168). Switch 270 may be, for example, a single-pole single-throw (SPST) switch. Adjustable component 156 can be adjusted to produce different amounts of inductance between terminals 98-2 and 182. Component 156 may therefore sometimes be referred to herein as adjustable inductor or switchable inductor circuitry 156. Control circuitry 28 may control switch 270 using control signals on input 272. When switch 270 is placed in a closed state, inductor L3 is switched into use and adjustable inductor 156 exhibits an inductance L3 between terminals 122 and 124. Antenna signals may be conveyed over feed terminal 98-2 to peripheral structures 16 through closed switch 270 and inductor L3. When switch 270 is placed in an open state, inductor L3 is switched out of use and adjustable inductor 156 exhibits an essentially infinite amount of inductance between terminals 98-2 and 182. Antenna signals may not be conveyed over feed terminal 98-2 and peripheral structures 16 when switch 270 is opened. If desired, switch 270 may be opened when antenna feed P2 is disabled.

Figure 11:
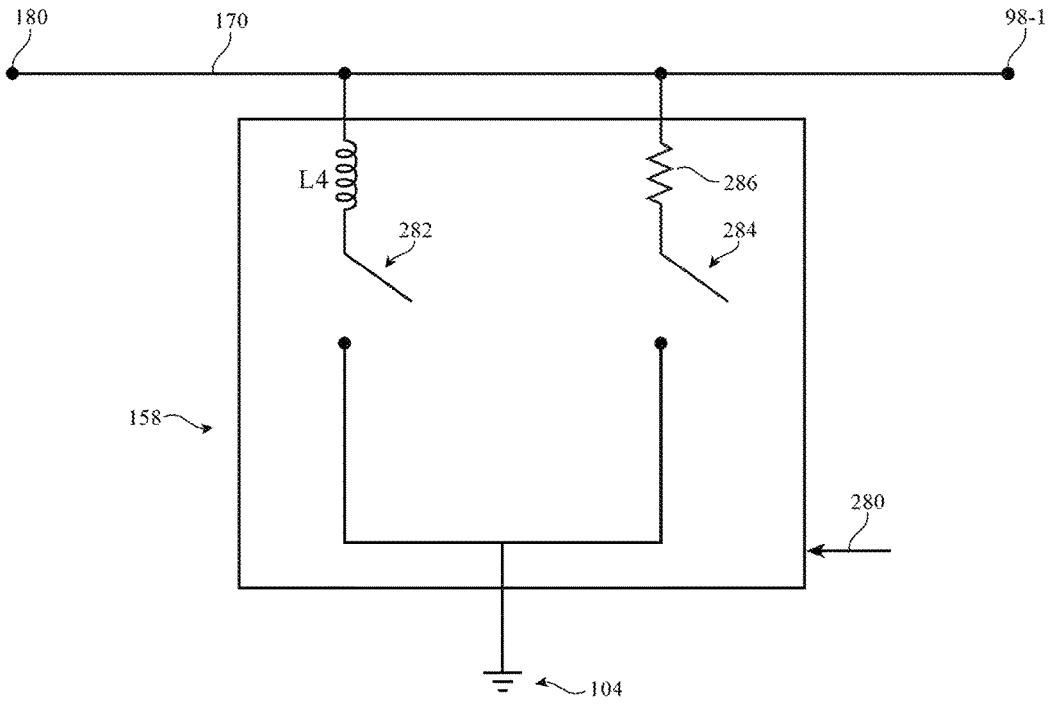
FIG. 11 is a diagram of an illustrative shunt switch that may be used in an antenna in accordance with an embodiment.

FIG. 11 is a circuit diagram showing circuit elements that may be used in forming adjustable component 158 of FIG. 6. As shown in FIG. 11, adjustable component 158 may include an inductor L4 coupled in series with first switch 282 between antenna feed path 170 and ground 104. Component 158 may include a resistor 286 coupled in series with second switch 284 between signal antenna feed path 170 and ground 104. Switches 282 and 284 may be, for example, single-pole single-throw (SPST) switches. Collectively, component 158 may be, for example, a shunt single-pole double-throw switch that selectively forms a shunt path from feed path 170 to ground 104.

Resistor 286 in adjustable component 158 may, for example, have a resistance of 0 Ohms or any other desired resistance. Control circuitry 28 may provide control signals over control input 280 to selectively open and close switches 282 and 284. Control circuitry 28 may close switch 284 and open switch 282 to short antenna signals on peripheral structures 16 to ground 104. This may effectively form a return path such as return path 110 of FIG. 4 from peripheral structures 16 to ground 104 at the location of terminal 180. Control circuitry 28 may close switch 284 and open switch 282 when antenna feed P1 is disabled, for example. When antenna feed P1 is enabled, switch 284 may be in an open state so that antenna signals may flow between terminals 98-1 and 180 without being shunted to ground. Control circuitry 28 may open or close switch 282 to adjust the inductance of antenna 40 at the location of feed conductor 170 if desired. The example of FIG. 11 in which component 158 is coupled between feed arm 170 and ground 104 is merely illustrative. If desired, component 158 may be coupled between any desired location on signal conductor 94 of transmission line 92 (FIG. 3) and ground 104. Inductor L4 may, if desired, be omitted from adjustable component 158.

Figure 12:
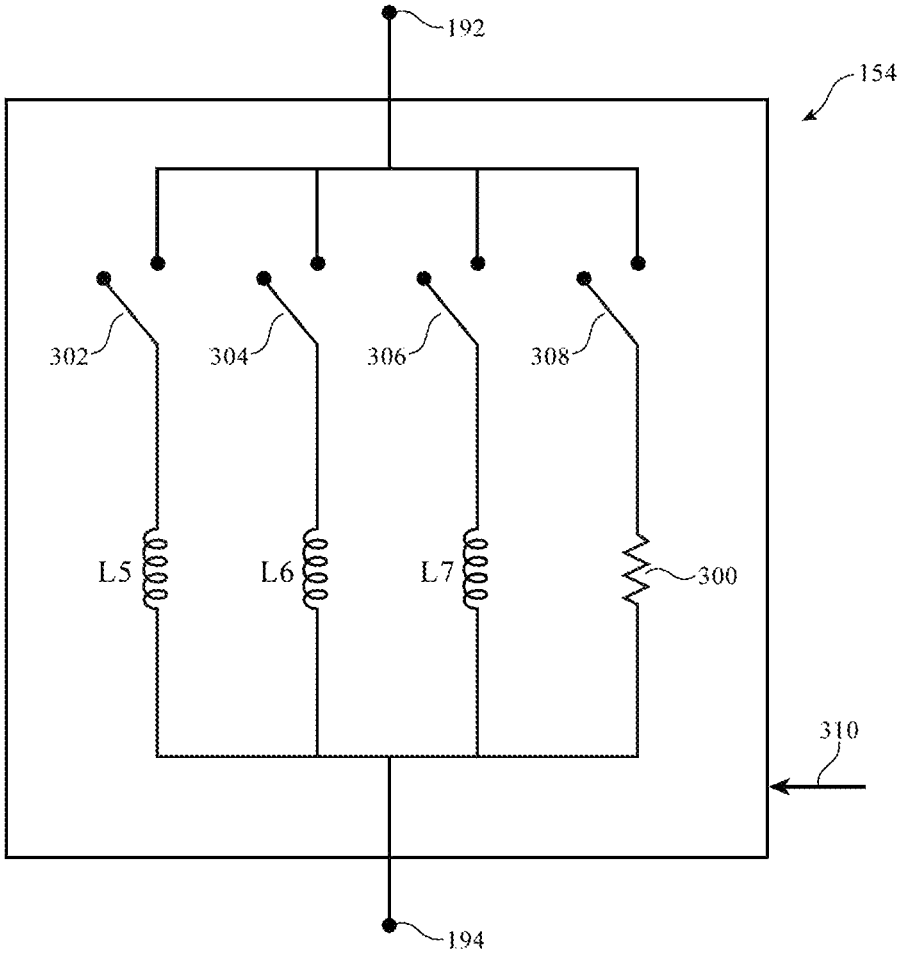
FIG. 12 is a diagram of illustrative aperture tuning circuitry that may be used in an antenna in accordance with an embodiment.

FIG. 12 is a circuit diagram showing circuit elements that may be used in forming adjustable aperture tuning circuitry 154 of FIG. 6. As shown in FIG. 12, adjustable component 154 may include a resistor 300 coupled in series with switch 308, a first inductor L5 coupled in series with switch 302, a second inductor L6 coupled in series with switch 304, and a third inductor L7 coupled in series with switch 306 in parallel between terminal 192 and terminal 194. Inductors L5-L7 may be used in providing antenna 40 with an adjustable amount of inductance. Control circuitry 28 may adjust component 154 to produce different amounts of inductance between terminal 192 and terminal 194 by controlling the state of switching circuitry such as switches 302-308 using control signals on control input 310. Switches 302-308 may each be, for example, single-pole single-throw (SPST) switches. Resistor 300 may have a resistance of 0 Ohms or any other desired resistance.

Control signals on path 310 may be used to switch any desired combination of one or more of inductors L5-L7 and resistor 300 into use between terminals 192 and 194. As an example, control circuitry 28 may close switch 308 while opening switches 302-306 to switch resistor 300 into use between terminals 192 and 194. In this scenario, antenna signals on peripheral conductive structures 16 may be shorted to from terminal 194 to ground 104 at terminal 192 (e.g., circuitry 154 may form a return path such as return path 110 of FIG. 4 for antenna 40). If desired, control circuitry 28 may open switch 308 while closing one or more of switches 302-306 to adjust the inductance provided by aperture tuning circuitry 154. Switching different combinations of inductors L5-L7 into use between terminals 192 and 194 may tune the resonance of antenna 40 within low band LB. For example, control circuitry 28 may close switch 302 and open switches 304-308 to tune the low band performance of antenna 40 as shown by curve 222 of FIG. 7, may close switch 304 and open switches 302, 306, and 308 to tune the low band performance of antenna 40 as shown by curve 224, and may close switch 306 and open switches 302, 304, and 308 to tune the low band performance of antenna 40 as shown by curve 226. The example of FIG. 12 is merely illustrative. In general, there may be any desired number of inductors coupled in parallel between terminals 192 and 194. The examples of FIGS. 9-12 are merely illustrative. In general, adjustable components 152, 154, 156, 158, and 160 may each include any desired number of inductive, capacitive, resistive, and switching elements arranged in any desired manner (e.g., in series, in parallel, in shunt configurations, etc.).

Figure 13:
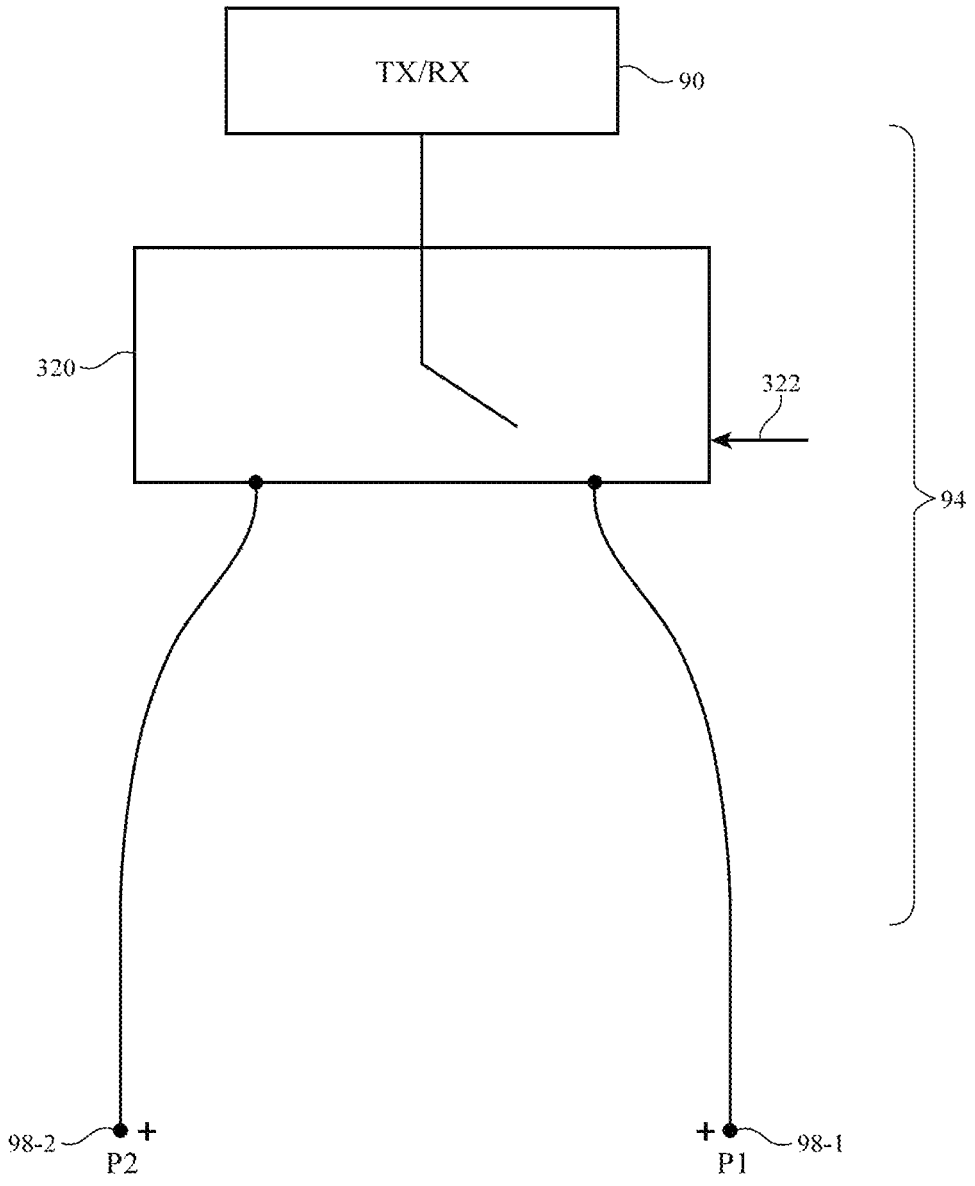
FIG. 13 is a diagram of illustrative antenna feed switching circuitry that may be used to selectively enable one of multiple different antenna feeds in an antenna in accordance with an embodiment.

If desired, additional switching circuitry may be coupled between radio-frequency transceiver circuitry 90 and antenna feeds P1 and P2 for selectively activating one of antenna feeds P1 and P2 at a given time. FIG. 13 is a schematic diagram showing how additional switching circuitry may be used to selectively activate antenna feeds for antenna 40. As shown in FIG. 13, switching circuit 320 may be interposed on signal conductor 94 of transmission line 92. Control circuitry 28 may provide control signals to switching circuit 320 over input 322. Control circuitry 28 may control switch 320 to selectively route radio-frequency signals between transceiver circuitry 90 and antenna feed terminal 98-2 of antenna feed P2 and between transceiver circuitry 90 and antenna feed terminal 98-1 of antenna feed P1. When antenna feed P2 is active, control circuitry 28 may place switch 320 in a first state in which signals are routed between transceiver 90 and feed terminal 98-2. When antenna feed P1 is to be activated, control circuitry 28 may place switch 320 in a second state in which signals are routed between transceiver 90 and feed terminal 98-1. This example is merely illustrative. In general, switching circuitry 320 may include any desired number of switches arranged in any desired configuration. Switching circuitry 320 may be omitted if desired (e.g., antenna feeds P1 and P2 may be selectively activated using only adjustable circuitry 156 and 158 of FIG. 6).

Control circuitry 28 may adjust the switching circuitry of FIGS. 9-13 when placing antenna 40 in the left hand head mode, right hand head mode, and free space mode (e.g., while processing step 252 of FIG. 8 to ensure that the optimal antenna feed is activated and that the adjustable components of antenna 40 are placed in a suitable configuration to ensure optimal antenna efficiency in each frequency band of interest). Control circuitry 28 may adjust the switching circuitry of FIGS. 9-13 based on the monitored operating environment of device 10.

Figure 14:
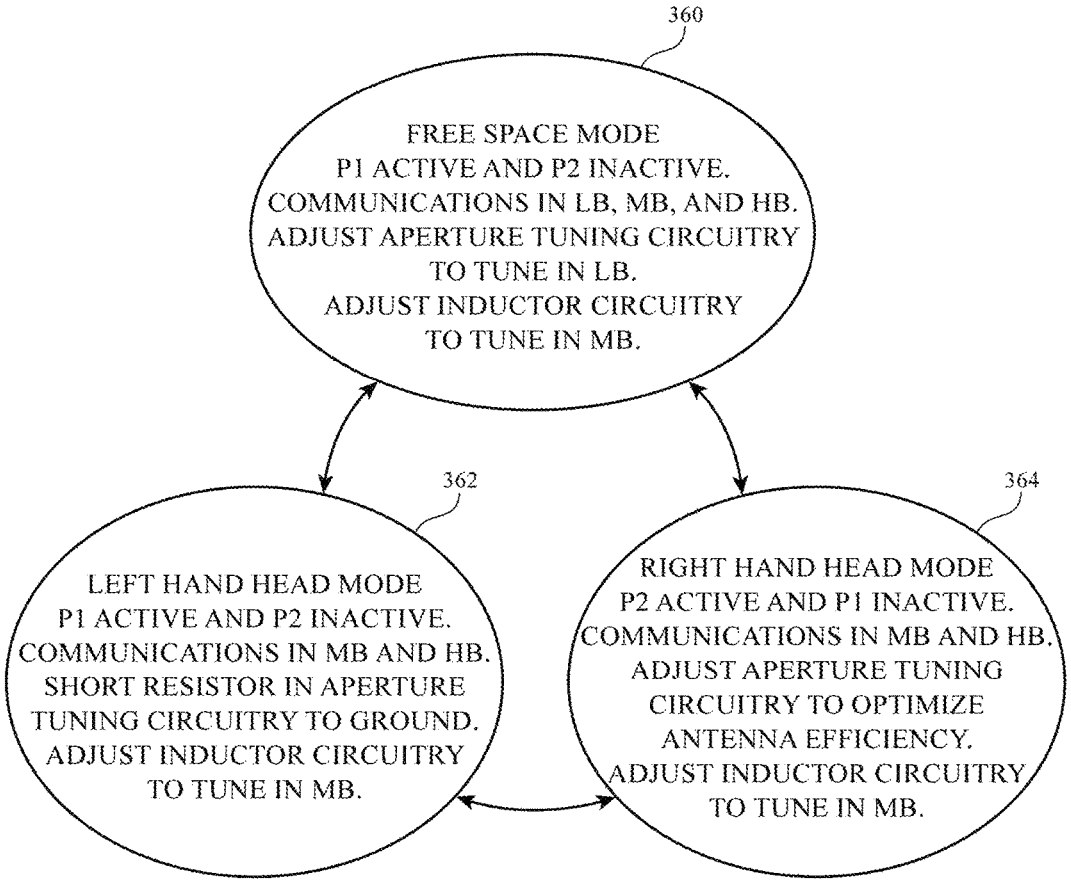
FIG. 14 is a state diagram showing illustrative antenna operating modes for an electronic device in accordance with an embodiment.

A state diagram showing illustrative operating modes for antenna 40 is shown in FIG. 14. As shown in FIG. 14, antenna 40 may be operable in a free space mode 360, a left hand head mode 362, and a right hand head mode 364. Control circuitry 28 may identify which mode is to be used based on the monitored operating environment of device 10 (e.g., using the sensor data and other information gathered while processing step 250 of FIG. 8) and may adjust tunable components 152, 154, 156, 158, and 160 of FIG. 6 to place antenna 40 in the corresponding operating mode.

When operating in free space mode 360, control circuitry 28 may enable antenna feed P1 and may disable antenna feed P2. For example, control circuitry 28 may control switch 320 of FIG. 13 to route signals between transceiver 90 and antenna feed terminal 98-1 of antenna feed P1. If desired, control circuitry 28 may open switch 270 in adjustable component 156 (FIG. 10) to decouple antenna feed terminal 98-2 from peripheral structures 16 instead of or in addition to adjusting switch 320. Control circuitry 28 may open switches 284 and 286 in adjustable component 158 (FIG. 11) so that radio-frequency signals are routed from antenna feed terminal 98-1 to point 180 on peripheral structures 16. When it is desired to transmit and receive low band signals in band LB, control circuitry 28 may control the switches of aperture tuning circuit 154 to switch an appropriate one of inductors L5, L6, and L7 into use, thereby tuning the low band response of antenna 40. The low band response of antenna 40 may be supported by, for example, resonance of the portion of conductive structures 16 to the left of feed P1 or any other desired portion of conductive structures 16 and antenna ground 104. Control circuitry 28 may, if desired, control switching circuitry 260 of adjustable components 152 and/or 160 (FIG. 9) to tune antenna 40 to a desired frequency within midband MB. The midband response of antenna 40 may be supported by, for example, resonance of the portion of conductive structures 16 to the right of feed P1 or any other desired portion of conductive structures 16 and antenna ground 104. Peripheral structures 16 may indirectly feed parasitic element 162 (FIG. 6) via near field coupling to provide coverage in high band HB. In free space mode 360, antenna 40 may cover frequencies in low band LB, midband MB, and high band HB (FIG. 7) with satisfactory antenna efficiency.

In free space mode 360, control circuitry 28 may collect and analyze sensor data such as proximity sensor data, orientation sensor data, connector sensor data, temperature sensor data, and other sensor data, may collect and analyze received signal strength data, call state data, data indicative of whether audio is being played through ear speaker 26 (FIG. 1), data indicative of what type of headphones or other accessories are being used with device 10, and information about other wireless settings, and may collect and analyze antenna performance information such as antenna impedance information and other antenna feedback information to determine whether device 10 is being used in an operating environment such as a left hand head environment or right hand head environment that loads antenna 40 in a way that can be compensated by adjusting the adjustable circuitry of antenna 40. Control circuitry 28 may continue to operate antenna 40 in free space mode 360 while the gathered information indicates that device 10 has not entered the left or right hand head device operating environments. Control circuitry 28 may, for example, operate antenna 40 in free space mode 360 when the data gathered while processing step 250 of FIG. 8 indicates that device 10 is not being used adjacent to the user's head and/or when the data indicates that device 10 is not being held by the user's left or right hand.

If it is determined that device 10 is being held in the left hand of a user and adjacent to the user's head (e.g., a non-free-space operating environment in which antenna 40 is being loaded along edge 12-1 and device 10 is adjacent to the user's head), control circuitry 28 may adjust the circuitry of antenna 40 to place antenna 40 in left hand head mode 362. When operating in left hand head mode 362, control circuitry 28 may enable antenna feed P1 and may disable antenna feed P2. For example, control circuitry 28 may control switch 320 of FIG. 13 to route signals between transceiver 90 and antenna feed terminal 98-1 of antenna feed P1. If desired, control circuitry 28 may open switch 270 in adjustable component 156 (FIG. 10) to decouple antenna feed terminal 98-2 from peripheral structures 16 instead of or in addition to adjusting switch 320. Control circuitry 28 may open switches 284 and 286 in adjustable component 158 (FIG. 11) so that radio-frequency signals are routed from antenna feed terminal 98-1 to point 180 on peripheral structures 16.

Control circuitry 28 may close switch 308 of aperture tuning circuitry 154 to short terminal 194 on conductive structures 16 to terminal 192 on ground 104 (FIG. 12). This may short antenna currents on peripheral structures 16 to ground 104 at the location of aperture tuner 154 so that the state of adjustable circuit 152 has no effect on the resonant frequency of antenna 40 (e.g., antenna currents do not pass through component 152 because the currents are shorted to ground prior to reaching component 152). Control circuitry 28 may control switch 266 of adjustable component 160 to switch at least one of inductors L1 and L2 into use between terminals 202 and 200 (FIG. 9) and to adjust the resonant frequency of antenna 40 within midband MB. In left hand head mode 362, antenna 40 may cover frequencies in midband MB and high band HB (e.g., coverage in low band LB may not be supported by left hand head mode 362). The midband response of antenna 40 may be supported by, for example, resonance of the portion of conductive structures 16 to the right of aperture tuning circuitry 154 or any other desired portion of conductive structures 16 and antenna ground 104. Peripheral structures 16 may indirectly feed parasitic element 162 (FIG. 6) via near field coupling to provide coverage in high band HB.

By operating antenna 40 in this way during left hand head mode 362, antenna current hotspots may be shifted away from left side 12-1 and towards right side 12-2 of device 10. This may mitigate the loading of antenna 40 by the user's left hand and any corresponding detuning of antenna 40. In left hand head mode 362, control circuitry 28 may monitor for conditions indicating that device 10 is being operated in a free space environment (in which case device 10 can transition to mode 360) or is being held in the right hand and adjacent to the head of the user (in which case device 10 can transition to right hand head mode 364). Control circuitry 28 may continue to operate antenna 40 in left hand head mode 362 while the gathered information indicates that device 10 has not entered the right hand head operating environment or the free space operating environment. Control circuitry 28 may, for example, operate antenna 40 in left hand head mode 360 when the data gathered while processing step 250 of FIG. 8 indicates that device 10 is being used adjacent to the user's head and that device 10 is being held by the user's left hand.

If it is determined that device 10 is being held in the right hand of a user and adjacent to the user's head (e.g., a non-free-space operating environment in which antenna 40 is being loaded along edge 12-2 and device 10 is adjacent to the user's head), control circuitry 28 may adjust the circuitry of antenna 40 to place antenna 40 in right hand head mode 364. When operating in right hand head mode 364, control circuitry 28 may enable antenna feed P2 and may disable antenna feed P1. For example, control circuitry 28 may control switch 320 of FIG. 13 to route signals between transceiver 90 and antenna feed terminal 98-2 of antenna feed P2. If desired, control circuitry 28 may close switch 270 in adjustable component 156 (FIG. 10) to couple antenna feed terminal 98-2 to peripheral structures 16. Control circuitry 28 may close switch 284 in adjustable component 158 (FIG. 11) so that radio-frequency antenna signals on peripheral structures 16 are shorted to ground 104 through zero-ohm resistor 286 instead of passing to antenna feed terminal 98-1. Because the antenna currents are shorted to ground 104 by adjustable component 158 in this mode, the state of adjustable circuit 160 has no effect on the resonant frequency of antenna 40 (e.g., antenna currents do not pass through component 160 because the currents are shorted to ground at element 158 prior to reaching component 160).

Control circuitry 28 may control switch 266 in adjustable component 152 to switch at least one of inductors L1 and L2 of adjustable component 152 into use between terminals 196 and 198. This may adjust the resonant frequency of antenna 40 within midband MB. Control circuitry 28 may open switch 308 of aperture tuning circuitry 154 to decouple resistor 300 from ground (FIG. 12). Control circuitry 28 may control switches 302-306 of FIG. 12 to couple one or more of inductors L5-L7 to ground. In this configuration (e.g., when feed P2 is active and P1 is inactive), aperture tuning circuitry 154 may form adjustable matching circuitry having an adjustable impedance that is controlled by opening and closing switches 302-306 to adjust the antenna efficiency of antenna 40.

In right hand head mode 364, antenna 40 may cover frequencies in midband MB and high band HB (e.g., coverage in low band LB may not be supported by right hand head mode 364). The midband response of antenna 40 may be supported by, for example, resonance of the portion of conductive structures 16 to the left of disabled antenna feed P1 or any other desired portion of conductive structures 16 and antenna ground 104. Peripheral structures 16 may indirectly feed parasitic element 162 (FIG. 6) via near field coupling to provide coverage in high band HB.

By operating antenna 40 in this way during right hand head mode 364, antenna current hotspots may be shifted away from right side 12-2 and towards left side 12-1 of device 10. This may mitigate the loading of antenna 40 by the user's right hand and any corresponding detuning of antenna 40. In right hand head mode 364, control circuitry 28 may monitor for conditions indicating that device 10 is being operated in free space (in which case device 10 can transition to mode 360) or is being held in the left hand and adjacent to the head of the user (in which case device 10 can transition to left hand head mode 362). Control circuitry 28 may continue to operate antenna 40 in right hand head mode 364 while the gathered information indicates that device 10 has not entered the left hand head operating environment or free space operating environment. Control circuitry 28 may, for example, operate antenna 40 in right hand head mode 364 when the data gathered while processing step 250 of FIG. 8 indicates that device 10 is being used adjacent to the user's head and that device 10 is being held by the user's right hand.

Figure 15:
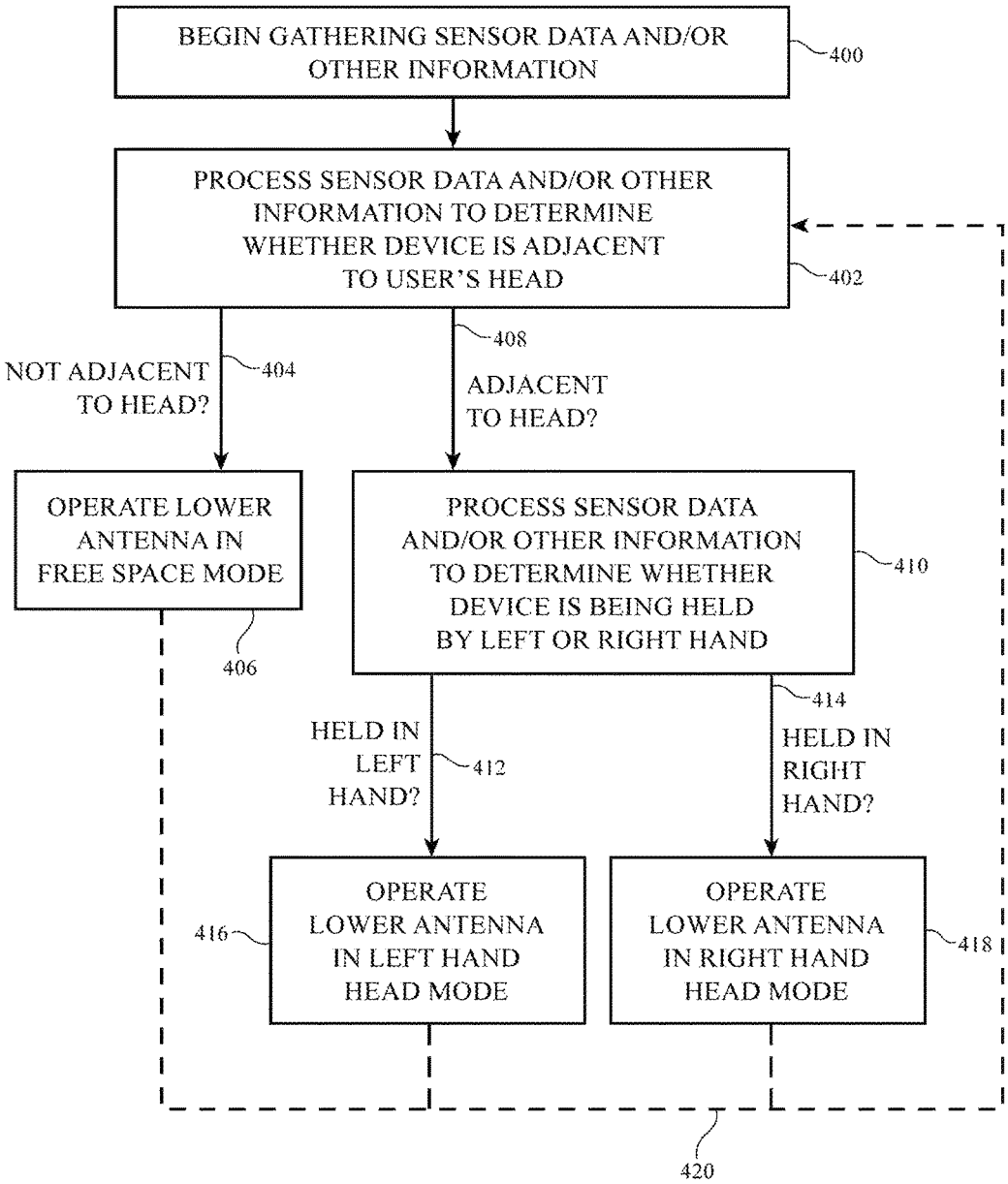
FIG. 15 is a flow chart of illustrative steps that may be involved in determining an operating mode to use for an antenna in accordance with an embodiment.

FIG. 15 is a flow chart of exemplary steps that may be performed by control circuitry 28 in switching between operating modes for antenna 40. At step 400, control circuitry 28 may begin to collect sensor data such as proximity sensor data, orientation sensor data, connector sensor data, temperature sensor data, information about the type of headphones or other accessories that are being used with device 10, and other sensor data, may begin to collect received signal strength data, call state data, data indicative of whether audio is being played through ear speaker 26 (FIG. 1), and other wireless settings, and/or may begin to collect antenna performance information such as antenna impedance information and other antenna feedback information. This data may be indicative of the operating environment of device 10. Control circuitry 28 may continue to collect this data and information while processing the steps of FIG. 15.

At step 402, control circuitry 28 may process the gathered data and information indicative of the operating environment of device 10 to determine whether device 10 is being held adjacent to the head of a user. If control circuitry 28 determines that device 10 is being held adjacent to the head of a user, processing may proceed to step 410 as shown by path 408. If control circuitry 28 determines that device 10 is not being held adjacent to the head of a user, processing may proceed to step 406 as shown by path 404.

As one example, control circuitry 28 may determine that device 10 is adjacent to the head of a user when it is determined that audio data is being played through ear speaker 26 (FIG. 1) and may determine that device 10 is not adjacent to the head of a user when it is determined that no audio data is being played through ear speaker 26. This example is merely illustrative. In general, any desired combination of data gathered at step 400 may be used to make the determination of step 402.

At step 406, control circuitry 28 may place antenna 40 in free space mode 360 (FIG. 14). In other words, control circuitry 28 may operate antenna 40 in free space mode 360 whenever device 10 is not being held adjacent to the head of a user. If desired, processing may loop back to step 402 as shown by path 420 to continually monitor whether device 10 has been moved adjacent to the head of a user.

At step 410, control circuitry 28 may process the gathered data and information indicative of the operating environment of device 10 to determine whether device 10 is being held in the user's left hand or right hand. If control circuitry 28 determines that device 10 is being held in the user's left hand, processing may proceed to step 416 as shown by path 412. If control circuitry 28 determines that device 10 is being held in the user's right hand, processing may proceed to step 418 as shown by path 414.

At step 416, control circuitry 28 may place antenna 40 in left hand head mode 362. In other words, control circuitry 28 may operate antenna 40 in left hand head mode whenever device 10 is determined to be held in the user's left hand and adjacent to the user's head. If desired, processing may loop back to step 402 as shown by path 420 to continually monitor device 10 for changes in operating environment. For example, control circuitry 28 may update the operating mode of antenna 40 when it is determined that device 10 has moved away from the user's head and/or been moved to the user's right hand.

At step 418, control circuitry 28 may place antenna 40 in right hand head mode 364. In other words, control circuitry 28 may operate antenna 40 in right hand head mode whenever device 10 is determined to be held in the user's right hand and adjacent to the user's head. If desired, processing may loop back to step 402 as shown by path 420 to continually monitor device 10 for changes in operating environment. For example, control circuitry 28 may update the operating mode of antenna 40 when it is determined that device 10 has moved away from the user's head and/or been moved to the user's left hand. In some scenarios, the gathered data indicative of the operating environment of device 10 may indicate that neither hand is adjacent to antenna 40 (e.g., that the user is not holding device 10 even though control circuitry 28 determined that device 10 is adjacent to the user's head). In this scenario, processing may jump to step 406 to place antenna 40 in free space mode 360. If desired, control circuitry may adjust the transmit power level of antenna 40 based on the gathered information and data indicative of the operating environment of device 10 (e.g., to minimize signal absorption by the user's body while also ensuring satisfactory communications link quality and conserving battery power). In this way, control circuitry 28 may continually monitor the operating environment of device 10 to ensure that antenna 40 has satisfactory antenna efficiency in each band of interest regardless of how device 10 is being held by a user.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

peripheral conductive housing structures, wherein a segment of the peripheral conductive housing structures extends between first and second dielectric-filled gaps in the peripheral conductive housing structures;

an antenna that comprises the segment, an antenna ground separated from the segment by a slot, a switch coupled between a first point on the segment and the antenna ground, an adjustable component coupled between a second point on the segment and the antenna ground, a first antenna feed coupled between a third point on the segment and the antenna ground, and a second antenna feed coupled between a fourth point on the segment and the antenna ground; and control circuitry coupled to the antenna and configured to place the antenna into a selected one of:

a first state in which the first antenna feed is active, the second antenna feed is inactive, and the switch is closed, and a second state in which the first antenna feed is inactive, the second antenna feed is active, the switch is open, and the adjustable component tunes a frequency response of the antenna.

2. The electronic device defined in claim 1, further comprising:

an additional adjustable component coupled between a fifth point on the segment and the antenna ground.

3. The electronic device defined in claim 2, wherein the first point is interposed between the first dielectric-filled gap and the second point, the second point is interposed between the first and third points, the third point is interposed between the second and fourth points, the fourth point is interposed between the third point and the second dielectric-filled gap, and the fifth point is interposed between the third point and the second dielectric-filled gap.

4. The electronic device defined in claim 1, wherein the first point is interposed between the first dielectric-filled gap and the second point, the second point is interposed between the first and third points, the third point is interposed between the second and fourth points, and the fourth point is interposed between the third point and the second dielectric-filled gap.

5. The electronic device defined in claim 4, further comprising:

sensor circuitry configured to gather sensor data, wherein the control circuitry is configured to place the antenna into the selected one of the first and second states based on the sensor data.

6. The electronic device defined in claim 5, wherein the sensor circuitry comprises a sensor selected from the group consisting of: an accelerometer, a compass, an impedance sensor, and a gyroscope.

7. The electronic device defined in claim 4, wherein the electronic device has a first edge and a second edge that is different from the first edge, the first gap is formed in the peripheral conductive structures along the first edge, and the second gap is formed in the peripheral conductive structures along the second edge.

8. The electronic device defined in claim 4, wherein the frequency response comprises a resonance at frequencies within a cellular telephone communications band.

9. The electronic device defined in claim 8, wherein the cellular telephone communications band comprises frequencies between 700 MHz and 960 MHz.

10. The electronic device defined in claim 1, further comprising:

a display having a display cover layer mounted to the peripheral conductive housing structures; and a rear housing wall, wherein the peripheral conductive housing structures surround a periphery of the electronic device and extend from the rear housing wall to the display cover layer.

11. The electronic device defined in claim 1, wherein the adjustable component comprises a switchable inductor.

12. An electronic device, comprising:

peripheral conductive housing sidewalls; and an antenna, wherein the antenna comprises:

a segment of the peripheral conductive housing sidewalls having opposing ends defined by first and second gaps in the peripheral conductive housing sidewalls, an antenna ground separated from the segment by a slot, a switch coupled between a first point on the segment and the antenna ground across the slot, a first antenna tuning component coupled between a second point on the segment and the antenna ground across the slot, a first antenna feed coupled between a third point on the segment and the antenna ground across the slot, a second antenna feed coupled between a fourth point on the segment and the antenna ground across the slot, and a second antenna tuning component coupled between a fifth point on the segment and the antenna ground across the slot, wherein the first point is interposed between the first gap and the second point, the second point is interposed between the first and third points, the third point is interposed between the second and fourth points, and the fourth and fifth points are both interposed between the third point and the second gap.

13. The electronic device defined by claim 12, further comprising:

control circuitry configured to adjust the first and second antenna tuning components to tune a frequency response of the antenna.

14. The electronic device defined in claim 13, further comprising:

sensor circuitry configured to generate sensor data, wherein the control circuitry is configured to toggle the switch and to adjust the first and second antenna tuning components based on the sensor data.

15. The electronic device defined in claim 14, wherein the sensor circuitry comprises a sensor selected from the group consisting of:

an accelerometer, a compass, and impedance sensor, and a gyroscope.

16. The electronic device defined in claim 12, further comprising:

control circuitry, wherein the control circuitry is configured to place the antenna into a selected one of:

a first operating mode in which the first antenna feed is enabled and the second antenna feed is disabled, and a second operating mode in which the first antenna feed is disabled and the second antenna feed is enabled.

17. The electronic device defined in claim 16, wherein the switch is closed in the first mode of operation and open in the second mode of operation.

18. An antenna comprising:

an antenna ground;

a conductive segment having a first end separated from the antenna ground by a first gap and an opposing second end separated from the antenna ground by a second gap, wherein a dielectric slot extends between the conductive segment and the antenna ground from the first gap to the second gap;

a switch coupled between a first point on the conductive segment and the antenna ground across the slot;

a first antenna feed coupled between a second point on the conductive segment and the antenna ground, the first point being interposed between the first gap and the second point; and a second antenna feed coupled between a third point on the conductive segment and the antenna ground, wherein the second point is interposed between the first and third points, the third point is interposed between the second point and the second gap, and the antenna is operable in:

a first mode in which the first antenna feed is active, the second antenna feed is inactive, and the switch forms a short circuit between the conductive segment and the antenna ground, and a second mode in which the first antenna feed is inactive, the second antenna feed is active, and the switch forms an open circuit between the conductive segment and the antenna ground.

19. The antenna defined in claim 18, further comprising:

a tunable component coupled between a fourth point on the conductive segment and the antenna ground, wherein the fourth point is interposed between the first and second points, and, when the antenna is in the second mode, the tunable component is configured to tune a frequency response of the antenna within a frequency band that comprises frequencies between 700 MHz and 960 MHz.

20. The antenna defined in claim 19, further comprising:

an additional tunable component coupled between a fifth point on the conductive segment and the antenna ground, wherein the fifth point is interposed between the second point and the second gap.

* * * * *